US010043492B2

(12) United States Patent
Woo et al.

(10) Patent No.: US 10,043,492 B2
(45) Date of Patent: Aug. 7, 2018

(54) DISPLAY DRIVER, DISPLAY DEVICE, AND DISPLAY SYSTEM

(71) Applicant: SAMSUNG ELECTRONICS CO., LTD., Suwon-si (KR)

(72) Inventors: Soo-young Woo, Hwaseong-si (KR); Yang-hyo Kim, Suwon-si (KR); Do-kyung Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 48 days.

(21) Appl. No.: 14/972,450

(22) Filed: Dec. 17, 2015

(65) Prior Publication Data

US 2016/0329033 A1 Nov. 10, 2016

(30) Foreign Application Priority Data

May 4, 2015 (KR) ..... 10-2015-0062650

(51) Int. Cl.

| | |
|---|---|
| ***G09G 5/39*** | (2006.01) |
| ***G09G 5/393*** | (2006.01) |
| ***G09G 3/20*** | (2006.01) |
| *G09G 5/397* | (2006.01) |

(52) U.S. Cl.

CPC ..... *G09G 5/393* (2013.01); *G09G 3/20* (2013.01); *G09G 5/397* (2013.01); *G09G 2310/0232* (2013.01); *G09G 2340/0442* (2013.01)

(58) Field of Classification Search

None

See application file for complete search history.

(56) References Cited

U.S. PATENT DOCUMENTS

| | | | | |
|---|---|---|---|---|
| 6,275,609 | B1 * | 8/2001 | Kugai | G06T 11/60 382/175 |
| 8,166,420 | B2 | 4/2012 | Sato | |
| 8,698,827 | B2 | 4/2014 | Yajima et al. | |
| 8,786,621 | B2 | 7/2014 | Han et al. | |
| 2001/0025300 | A1 * | 9/2001 | Miller | G06Q 10/107 709/206 |

(Continued)

FOREIGN PATENT DOCUMENTS

| | | |
|---|---|---|
| JP | 2004-053698 A | 2/2004 |
| JP | 2014-200075 A | 10/2014 |

(Continued)

*Primary Examiner* — Kyle Zhai

(74) *Attorney, Agent, or Firm* — Sughrue Mion, PLLC

(57) ABSTRACT

Provided are a display driver, a display device, and a display system. The display driver includes: an interface configured to receive a control signal and image data from a host, a sum of a number of columns and rows of the image data being less than a sum of a number of columns and rows of the display panel; an image splitter configured to split, based on the control signal, the image data into a plurality of image data respectively corresponding to a plurality of partial regions of the display panel, the plurality of partial regions being separate from each other; a storage configured to store the plurality of image data in a plurality of storage areas respectively corresponding to the plurality of partial regions; and a source driver configured to drive the display panel based on the plurality of image data output from the storage during one frame period.

20 Claims, 37 Drawing Sheets

(56) References Cited

U.S. PATENT DOCUMENTS

| | | | | |
|---|---|---|---|---|
| 2003/0090497 | A1* | 5/2003 | Yoshioka | G09G 5/00 345/660 |
| 2009/0073103 | A1 | 3/2009 | Tajiri | |
| 2013/0057763 | A1* | 3/2013 | Cha | G09G 5/006 348/554 |
| 2013/0155036 | A1* | 6/2013 | Kim | G09G 3/2092 345/204 |
| 2013/0194295 | A1 | 8/2013 | Chan et al. | |
| 2014/0287795 | A1* | 9/2014 | Lee | H04J 3/0685 455/550.1 |
| 2015/0012854 | A1 | 1/2015 | Choi et al. | |

FOREIGN PATENT DOCUMENTS

| | | | |
|---|---|---|---|
| KR | 10-0529786 | B1 | 11/2005 |
| KR | 10-2013-0065328 | A | 6/2013 |

* cited by examiner

FIG. 9A

| | |
|---|---|
| Command | Set_CA |
| Parameter | SC, EC, DUAL, LSIZE, RSIZE |
| Command | Set_PA |
| Parameter | SP, EP |

FIG. 9B

| Type | Access | D7 | D6 | D5 | D4 | D3 | D2 | D1 | D0 | Hex |
|---|---|---|---|---|---|---|---|---|---|---|
| Command | W | 0 | 0 | 1 | 0 | 1 | 0 | 1 | 0 | 0x2A |
| 1st para | W | SC[15] | SC[14] | SC[13] | SC[12] | SC[11] | SC[10] | SC[9] | SC[8] | 0x00 |
| 2nd para | W | SC[7] | SC[6] | SC[5] | SC[4] | SC[3] | SC[2] | SC[1] | SC[0] | 0x00 |
| 3rd para | W | EC[15] | EC[14] | EC[13] | EC[12] | EC[11] | EC[10] | EC[9] | EC[8] | 0x06 |
| 4th para | W | EC[7] | EC[6] | EC[5] | EC[4] | EC[3] | EC[2] | EC[1] | EC[0] | 0x3F |
| 5th para | W | 0 | 0 | 0 | 0 | 0 | 0 | 0 | DUAL | 0x01 |
| 6th para | W | 0 | 0 | LSIZE[5] | LSIZE[4] | LSIZE[3] | LSIZE[2] | LSIZE[1] | LSIZE[0] | 0x32 |
| 7th para | W | 0 | 0 | RSIZE[5] | RSIZE[4] | RSIZE[3] | RSIZE[2] | RSIZE[1] | RSIZE[0] | 0x0A |

FIG. 11A

| | |
|---|---|
| Command | Set_MPUCA1 |
| Parameter | SC, EC, LSIZE, RSIZE |
| Command | Set_PA |
| Parameter | SP, EP |

FIG. 11B

| | |
|---|---|
| Command | Set_MPUCA2 |
| Parameter | SC1, EC1, SC2, EC2 |
| Command | Set_PA |
| Parameter | SP, EP |

FIG. 12B

| | |
|---|---|
| Command | Set_CA |
| Para | SC, EC |
| Command | Set_PA |
| Para | SP, EP, DUAL, USIZE, DSIZE |

FIG. 13B

| Command | Set_MPUCA3 |
|---|---|
| Para | NPA[1:0], SC1, SC2, SC3, HSIZE1, HSIZE2, HSIZE3 |
| Command | Set_PA |
| Para | SP, EP |

FIG. 14B

| | |
|---|---|
| Command | Set_CA |
| Para | SC, EC |
| Command | Set_MPUPA1 |
| Para | NPA[1:0], SP1, SP2, SP3, VSIZE1, VSIZE2, VSIZE3 |

FIG. 15B

| Command | Set_MPUCA4 |
|---|---|
| Para | SC, EC, LSIZE, RSIZE |
| Command | Set_MPUPA4 |
| Para | SP, EP, USIZE, DSIZE |

DISPLAY DRIVER, DISPLAY DEVICE, AND DISPLAY SYSTEM

CROSS-REFERENCE TO RELATED APPLICATION

This application claims priority from Korean Patent Application No. 10-2015-0062650, filed on May 4, 2015 in the Korean Intellectual Property Office, the disclosure of which is incorporated herein in its entirety by reference.

BACKGROUND

Apparatuses and methods consistent with exemplary embodiments to a semiconductor device, and more particularly, to a display driver driving a display panel such that an image is displayed on the display panel, and a display device and a display system including the display driver.

Electronic devices having an image display function, such as a computer, a tablet personal computer (PC), a smartphone, a television, a portable multimedia player, a personal digital assistant, etc., include a display system. The display system includes a display panel, a display driver (or a display driving integrated circuit (DDI)), and a host processor. A display panel includes a plurality of pixels, and may be formed of a flat panel display such as a liquid crystal display (LCD), an organic light emitting diode (OLED) display, a flexible display, an active-matrix OLED (AMOLED) display, a plasma display panel (PDP), etc. A display driver drives a display panel based on display data corresponding to an image to be displayed. An image is displayed on the display panel as pixels are driven according to a data signal (display data) provided by the display driver. The display driver may receive a control signal and display data from a host processor. The host processor and the display driver may transmit and/or receive signals via a high speed interface.

SUMMARY

Aspects of one or more exemplary embodiments provide a display driver capable of simultaneously updating a plurality of different regions of a display panel, and a display device and a display system including the display driver.

According to an aspect of another exemplary embodiment, there is provided a display driver for driving a display panel, the display driver including: an interface configured to receive a control signal and image data from a host, a sum of a number of columns and a number of rows of the image data being less than a sum of a number of columns and a number of rows of the display panel; an image splitter configured to split, based on the control signal, the image data into a plurality of image data respectively corresponding to a plurality of partial regions of the display panel, the plurality of partial regions being separate from each other; a storage configured to store the plurality of image data in a plurality of storage areas respectively corresponding to the plurality of partial regions; and a source driver configured to drive the display panel based on the plurality of image data output from the storage during one frame period.

The control signal may include a multiple partial update parameter indicating that a current operation is to update multiple partial regions of the display panel.

The control signal may further include address information of the plurality of storage areas.

The address information may include at least one of: a first indicator indicating a start column and an end column; and a second indicator indicating a start row and an end row.

The first indicator may indicate a start column and an end column of a minimum rectangular region including the plurality of storage areas; and the second indicator may indicate a start row and an end row of the minimum rectangular region.

The control signal may further include size information of the plurality of storage areas.

The size information may include at least one of a plurality of horizontal sizes and a plurality of vertical sizes respectively of the plurality of storage areas.

The interface may be configured to receive the control signal, to transmit a tearing effect signal in response to the received control signal, and to receive the image data in response to the transmitted tearing effect signal.

The interface may be configured to communicate with the host based on a MOBILE INDUSTRY PROCESSOR INTERFACE (MIPI) method.

The image splitter may be implemented as hardware.

The image splitter may be configured to control to store the plurality of image data into the plurality of storage areas of the storage by moving a write pointer of the storage based on an offset obtained from the control signal.

The image splitter may be configured to, when the write pointer corresponds to a write address of an end column of a first storage area, among the plurality of storage areas, obtain as the offset an address difference from the end column of the first storage area to a start column of a second storage area, among the plurality of storage areas.

The storage may be a frame memory configured to store frame image data corresponding to an image displayed during the one frame period.

The display driver may further include a line memory configured to store a horizontal line of image data output from the frame memory, such that the plurality of image data is provided to the source driver in horizontal line units.

The image splitter may be configured to, based on the control signal, control to update the plurality of storage areas respectively corresponding to the plurality of partial regions with the plurality of image data, and to control to maintain previous image data of a previous frame period in a storage area of the frame memory that does not correspond to any of the plurality of partial regions.

The storage may be a line memory configured to store a horizontal line of image data, such that the plurality of image data is provided to the source driver in horizontal line units.

The image splitter may be configured to, based on the control signal, control to update the plurality of storage areas respectively corresponding to the plurality of partial regions with the plurality of image data, and to control to store black data or white data in a storage area of the line memory that does not correspond to any of the plurality of partial regions.

The display driver may not include a frame memory.

The plurality of image data may have at least one of different horizontal sizes and different vertical sizes.

According to an aspect of another exemplary embodiment, there is provided a method of driving a display panel, the method including: receiving a control signal and image data from a host, a sum of a number of columns and a number of rows of the image data is less than a sum of a number of columns and a number of rows of the display panel; splitting, based on the control signal, the image data into a plurality of image data respectively corresponding to a plurality of partial regions of the display panel, the plurality of partial regions being separate from each other;

storing, in a storage, the plurality of image data in a plurality of storage areas respectively corresponding to the plurality of partial regions; and driving the display panel based on the plurality of image data output from the storage during one frame period.

The control signal may include a multiple partial update parameter indicating that a current operation is to update multiple partial regions of the display panel.

The control signal may further include address information of the plurality of storage areas.

The control signal may further include size information of the plurality of storage areas.

The receiving the control signal and the image data may include sequentially receiving the image data in row units from a start row to an end row of the plurality of partial regions.

The receiving the control signal and the image data may include receiving the control signal, transmitting a tearing effect signal in response to the received control signal, and receiving the image data in response to the transmitted tearing effect signal.

The storing may include storing the plurality of image data into the plurality of storage areas of the storage by moving a write pointer of the storage based on an offset obtained from the control signal.

The storing may further include, when the write pointer corresponds to a write address of an end column of a first storage area, among the plurality of storage areas, obtaining as the offset an address difference from the end column of the first storage area to a start column of a second storage area, among the plurality of storage areas.

The storage may be a frame memory configured to store frame image data corresponding to an image displayed during the one frame period.

The storing may include: updating the plurality of storage areas respectively corresponding to the plurality of partial regions with the plurality of image data; and maintaining previous image data of a previous frame period in a storage area of the frame memory that does not correspond to any of the plurality of partial regions.

The storage may be a line memory configured to store a horizontal line of image data, such that the plurality of image data is output to the display panel in horizontal line units.

The storing may include: updating the plurality of storage areas respectively corresponding to the plurality of partial regions with the plurality of image data; and storing black data or white data in a storage area of the line memory that does not correspond to any of the plurality of partial regions.

According to an aspect of another exemplary embodiment, there is provided a controller for a storage of a display driver, the controller including: a receiver configured to receive a control signal and image data from a host, a sum of a number of columns and a number of rows of the image data being less than a sum of a number of columns and a number of rows of the storage; and an image splitter configured to split, based on the control signal, the image data into a plurality of image data respectively corresponding to a plurality of partial regions of a display panel, and to control to store, for one frame period, the plurality of image data in a plurality of storage areas of the storage respectively corresponding to the plurality of partial regions, wherein the plurality of partial regions are separated from each other.

The control signal may include a multiple partial update parameter indicating that a current update operation is to update multiple partial regions of the display panel.

The control signal may further include address information of the plurality of storage areas.

The control signal may further include size information of the plurality of storage areas.

The image splitter may be configured to control to store the plurality of image data into the plurality of storage areas of the storage by controlling to move a write pointer of the storage based on an offset obtained from the control signal.

The image splitter may be configured to, when the write pointer corresponds to a write address of an end column of a first storage area, among the plurality of storage areas, obtain as the offset an address difference from the end column of the first storage area to a start column of a second storage area, among the plurality of storage areas.

The image splitter may be configured to control to store the plurality of image data in a frame memory for storing frame image data corresponding to an image displayed during the one frame period.

The image splitter may be configured to, based on the control signal, control to update the plurality of storage areas respectively corresponding to the plurality of partial regions with the plurality of image data, and to control to maintain previous image data of a previous frame period in a storage area of the frame memory that does not correspond to any of the plurality of partial regions.

According to an aspect of another exemplary embodiment, there is provided a method of storing image data in a storage, the method including: receiving a control signal and image data from a host, a sum of a number of columns and a number of rows of the image data being less than a sum of a number of columns and a number of rows of the storage; splitting, based on the control signal, the image data into a plurality of image data respectively corresponding to a plurality of partial regions of a display panel; and controlling to store, for one frame period, the plurality of image data in a plurality of storage areas of the storage respectively corresponding to the plurality of partial regions, wherein the plurality of partial regions are separate from each other.

The control signal may include a multiple partial update parameter indicating that a current operation is to update multiple partial regions of the display panel.

The control signal may further include address information of the plurality of storage areas.

The control signal may further include size information of the plurality of storage areas.

The controlling to store may include controlling to move a write pointer of the storage based on an offset obtained from the control signal.

The controlling to store may further include, when the write pointer corresponds to a write address of an end column of a first storage area, among the plurality of storage areas, obtaining as the offset an address difference from the end column of the first storage area to a start column of a second storage area, among the plurality of storage areas.

The controlling to store may include controlling to store the plurality of image data in a frame memory for storing frame image data corresponding to an image displayed during the one frame period.

The controlling to store the plurality of image data in the frame memory may include: controlling to update the plurality of storage areas respectively corresponding to the plurality of partial regions with the plurality of image data; and controlling to maintain previous image data of a previous frame period in a storage area of the frame memory that does not correspond to any of the plurality of partial regions.

According to an aspect of another exemplary embodiment, there is provided a display system including: a display panel; and a display driver, wherein the display driver is configured to update, during one frame period, multiple display areas of the display panel, and a sum of sizes of the multiple areas is less than a size of an entire display area of the display panel.

The display panel may include at least one of a liquid crystal display (LCD) panel, an organic light emitting diode (OLED) panel, an active-matrix OLED (AMOLED) panel, a curved edge panel, a multiple curved edge panel, and a flexible display.

According to an aspect of another exemplary embodiment, there is provided a display system including: a display panel for displaying an image; a host processor for generating update image data with respect to the display panel by merging first image data and second image data; and a display driving circuit for splitting the update image data received from the host processor into the first image data and the second image data, and updating a first partial region and a second partial region of the display panel that are separate from each other based on the first image data and the second image data in a single frame display period.

The host processor may provide the display driving circuit with split information about the update image data, and the display driving circuit may split the update image data into the first image data and the second image data based on the split information.

The display driving circuit may include a storage unit including a first storage region and a second storage region respectively corresponding to the first partial region and the second partial region of the display panel, and the split information may include address information about the first storage region and the second storage region.

The split information may include address information of a minimum rectangular region including the first storage region and the second storage region and size information of the first storage region and the second storage region with respect to at least one of a horizontal direction and a vertical direction.

According to an aspect of another exemplary embodiment, there is provided a display driver including: a receive interface via which image data and a control signal are received from an external host; an image splitting unit for splitting the image data into a plurality of partial image data based on the control signal; a storage unit for updating the plurality of storage regions that correspond to the plurality of partial image data and are split from one another, based on the plurality of partial image data; and a source driver for driving a display panel based on data output from the storage unit.

The image splitting unit may control the image data such that the image data is split based on split information generated from the control signal and stored in the plurality of storage regions.

According to an aspect of another exemplary embodiment, there is provided a display device including: a display panel for displaying one frame of image data; and a display driving circuit for receiving partial update image data and a control signal from the outside, splitting the partial update image data into first partial image data and second partial image data based on the control signal, and updating a first partial region and a second partial region of the display panel that are separate from each other, based on the first partial image data and the second partial image data in a single frame display period.

The first partial region and the second partial region may have the same sizes and locations with respect to at least one of a vertical direction and a horizontal direction.

BRIEF DESCRIPTION OF THE DRAWINGS

Exemplary embodiments will be more clearly understood from the following detailed description taken in conjunction with the accompanying drawings in which:

FIGS. 9A and 9B illustrate tables showing protocols for a setting command signal and command set parameters according to one or more exemplary embodiments;

FIGS. 11A and 11B illustrate tables showing protocols for a setting command signal according to exemplary embodiments;

FIG. 12B is a table showing a protocol for a setting command signal according to the multiple partial update method of FIG. 12A;

FIG. 13B is a table showing a protocol for a setting command signal according to the multiple partial update method of FIG. 13A;

FIG. 14B is a table showing a protocol for a setting command signal according to the multiple partial update method of FIG. 14A;

FIG. 15B is a table showing a protocol for a setting command signal according to the multiple partial update method of FIG. 15A;

DETAILED DESCRIPTION OF EXEMPLARY EMBODIMENTS

Figure 1:
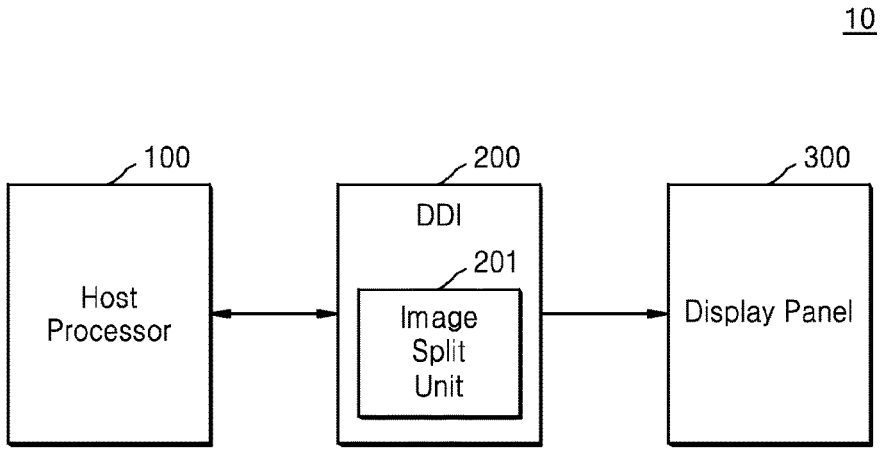
FIG. 1 is a block diagram illustrating a display system according to an exemplary embodiment.

Exemplary embodiments will now be described more fully with reference to the accompanying drawings, in which like reference numerals refer to like elements throughout. The application may, however, be embodied in many different forms, and should not be construed as being limited to exemplary embodiments set forth herein. Thus, the application may include all revisions, equivalents, or substitutions which are included in the concept and the technical scope related to the present application.

Terms such as "includes" or "may include" that may be used in various exemplary embodiments indicate the existence of a corresponding function, operation, or constituent that is disclosed, and are not intended to limit one or more additional functions, operations, or constituents. Also, in the present specification, it is to be understood that the terms such as "including," "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

As used herein, the term "or" includes any and all combinations of one or more of the associated listed items. For example, "A or B" may include A, B, or both A and B.

While terms "first" and "second" are used to describe various components, it is understood that these components are not limited by the terms "first" and "second". The terms "first" and "second" are used only to distinguish between each component. For example, these terms do not limit the order and/or importance of corresponding components. These terms may be used to distinguish one component from another. For example, a first user device and a second user device may be different user devices. Furthermore, a first component may indicate a second component or a second component may indicate a first component without conflicting with the inventive concept.

In the present specification, when a constituent element is "connected" or "coupled" to another constituent element, it may be construed that the constituent element is connected or coupled to the other constituent element not only directly, but also through at least one of other constituent elements interposed therebetween. On the other hand, when a constituent element is "directly connected" or "directly coupled" to another constituent element, it is understood that there is no other constituent element interposed therebetween.

The terms used herein in various exemplary embodiments are to describe exemplary embodiments only, and should not be construed to limit the various exemplary embodiments. Singular expressions, unless defined otherwise in contexts, include plural expressions.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "and/or" includes any and all combinations of one or more of the associated listed items. Expressions such as "at least one of," when preceding a list of elements, modify the entire list of elements and do not modify the individual elements of the list.

A display system according to various exemplary embodiments may be an electronic device having an image display function. For example, the electronic device may include at least one of a smartphone, a table personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, electronic bracelet, electronic necklace, electronic accessory, electronic tattoo, or a smart watch), etc.

In some exemplary embodiments, the display system may be a smart home appliance having an image display function. The smart home appliance may include at least one of a television, a digital video disk (DVD) player, a stereo system, a refrigerator, an air conditioner, a cleaner, an oven, a microwave oven, a washing machine, an air purifier, a set-top box, a TV box (e.g., Samsung HOMESYNC, Apple TV, or Google TV), game consoles, electronic dictionary, an electronic key, a camcorder, and an electronic frame.

In some exemplary embodiments, the display system may include at least one of various medical devices (e.g., magnetic resonance angiography (MRA), magnetic resonance imaging (MRI), computed tomography (CT), an imaging apparatus or an ultrasonic apparatus), a navigation device, a global positioning system (GPS) receiver, an event data recorder (EDR), a flight data recorder (FDR), a car infotainment device, electronic equipment for ships (e.g., navigation equipment for ships or a gyrocompass), avionics, security devices, head units for cars, industrial or home robots, automatic teller's machine (ATM) of financial institutions, point of sales (POP) of shops, an Internet of Things (IoT) device, etc.

In some exemplary embodiments, the display system may include at least one of furniture or a part of a building or a structure having an image display function, an electronic board, an electronic signature receiving device, a projector, and various measurement instruments (e.g., metering instruments for metering water supply, electricity, gas or radio waves). The electronic device including a display system according to various exemplary embodiments may be one of the above-described various devices or a combination thereof. Also, the display system may be a flexible device. It is understood to one of ordinary skill in the art that the display system according to various exemplary embodiments is not limited to the above-described devices.

Hereinafter, the display system according to various exemplary embodiments will be described with reference to the attached drawings. A user referred to in various exemplary embodiments may be a user who uses the display system or a device that uses the display system (for example, an artificial intelligence electronic device).

FIG. 1 is a block diagram illustrating a display system 10 according to an exemplary embodiment.

Referring to FIG. 1, the display system 10 may include a host processor 100 (as an example of a host), a display driver integrated circuit (IC) (DDI) 200, and a display panel 300.

The host processor 100 may control an overall operation of the display system 10. According to an exemplary embodiment, the host processor 100 may be implemented as a mobile application processor (AP). The host processor 100 may generate a control signal and image data corresponding to an image to be displayed on the display panel 300 and provide the DDI 200 with the image data and the control signal. The host processor 100 may transmit the image data and the control signal to the DDI 200 via an interface.

The DDI 200 may drive the display panel 300 based on the image data and the control signal transmitted from the host processor 100. The DDI 200 may process the image data based on the control signal to generate an image signal and transmit the image signal to the display panel 300.

The display panel 300 may include a plurality of pixels that are arranged in a matrix including rows and columns and display an image in frame units based on the image signal transmitted from the DDI 200. According to an exemplary embodiment, the display panel 300 may be formed of (e.g., include) a liquid crystal display (LCD), a light emitting diode (LED) display, an organic LED (OLED) display, an active-matrix OLED (AMOLED) display, a flexible display, a curved display, a curved edge display, a plural curved edge display, a plasma display panel (PDP), an electrophoretic display panel, or an electrowetting display panel. Alternatively, the display panel 300 may be formed of other types of flat panel displays or flexible displays.

The display system 10 according to the present exemplary embodiment may simultaneously update a plurality of partial regions of a screen of the display panel 300. In other words, the display system 10 may update a plurality of partial regions of the display panel 300 in a single frame display period. The plurality of partial regions may be regions that are partially or entirely separated from one another (e.g., having at least another region therebetween). For example, according to an exemplary embodiment, the plurality of partial regions may include at least one partial region corresponding to at least one curved edge of the display panel 300 (although it is understood that one or more other exemplary embodiments are not limited thereto). An update method according to the present exemplary embodiment as described above will be referred to below as a multiple partial update.

The host processor 100 may generate update image data by merging a plurality of image data that are to be respectively displayed in a plurality of partial regions on the display panel 300, and may provide the DDI 200 with the update image data and a control signal indicating that a current update mode is a multiple partial update. The control signal may include a multiple partial update signal and split information about the update image data.

The DDI 200 may split received update image data into a plurality of image data that are not merged, and may update the plurality of partial regions that are separated from one another, based on the plurality of image data. The DDI 200 may update the plurality of partial regions in a single frame display period. To this end, the DDI 200 may include an image splitting unit 201 (e.g., image splitter). The image splitting unit 201 may split update image data into a plurality of image data based on a control signal, such as a multiple partial update signal, and split information about the update image data. In some exemplary embodiments, the image splitting unit 201 may be implemented by hardware and/or circuitry.

As described above, according to the multiple partial update method of the present exemplary embodiment, a plurality of partial regions on the display panel 300 that are split or separated from one another may be simultaneously (e.g., in a single frame display period) updated. Also, the host processor 100 may transmit pieces of image data corresponding to partial regions that are being updated, as opposed to an image corresponding to the entire region of the display panel 300, thereby reducing power consumption of the display system 10. That is, the image data or update image data may be smaller in size than an entire display region of the display panel 300. Stated differently, a sum of a number of columns and a number of rows of the image data may be less than a sum of a number of columns and a number of rows of the display panel 300.

Figure 2:
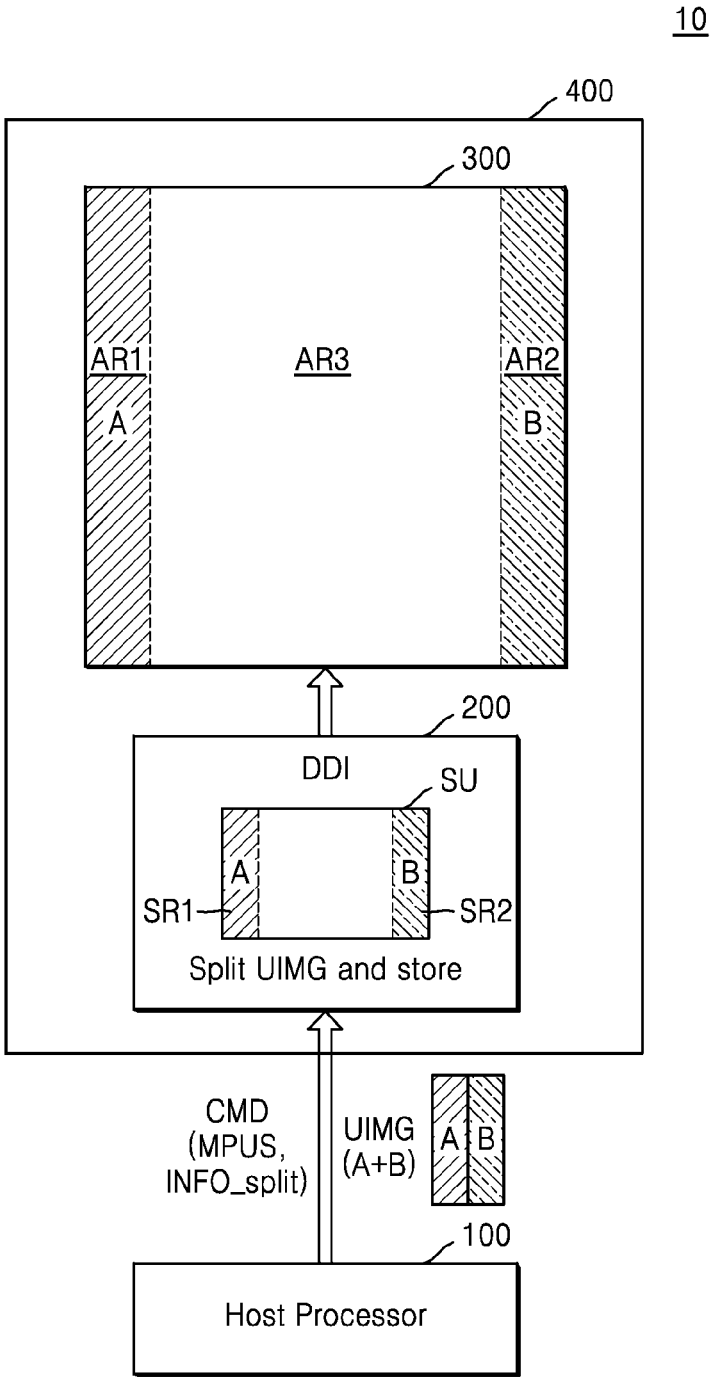
FIG. 2 is a view for explaining a multiple partial update method according to an exemplary embodiment.
Figure 3:
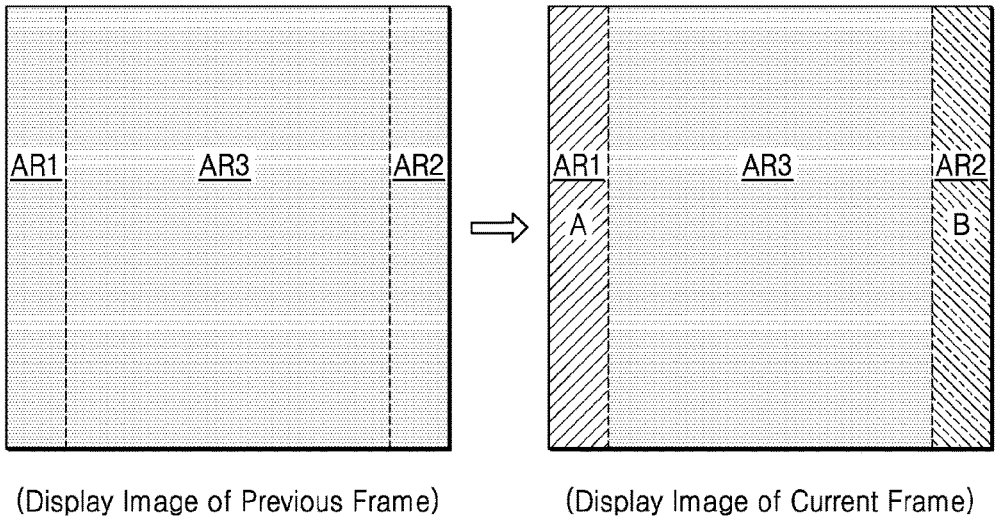
FIG. 3 illustrates an example in which an image displayed on a display panel is changed according to a multiple partial update method.

FIG. 2 is a view for explaining a multiple partial update method according to an exemplary embodiment, and FIG. 3 illustrates an example in which an image displayed on the display panel 300 is changed according to the multiple partial update method. The multiple partial update method according to an exemplary embodiment may be performed in the display system 10 of FIG. 1.

Referring to FIG. 2, the display system 10 may include the host processor 100, the DDI 200, and the display panel 300. According to an exemplary embodiment, the DDI 200 and the display panel 300 may be implemented (e.g., formed or provided) as a single module or a chip on glass, which may be referred to as a display device 400. According to another exemplary embodiment, the host processor 100 and the DDI 200 may be formed (e.g., implemented or provided) as a single module, a single system on chip, or a single package such as a multi-chip package.

The display panel 300 may include a plurality of partial regions, for example, a first partial region AR1, a second partial region AR2, and a third partial region AR3. Although the display panel 300 includes three partial regions in the present exemplary embodiment, it is understood that one or more other exemplary embodiments are not limited thereto and the display panel 300 may also include four or more partial regions. Hereinafter, it is assumed for convenience of description that the display panel 300 includes the first through third partial regions AR1, AR2, and AR3.

The first through third partial regions AR1, AR2, and AR3 may be rectangular, although it is understood that one or more other exemplary embodiments are not limited thereto. In the present exemplary embodiment, the first partial region AR1 and the second partial region AR2 are separate from each other.

When updating the first partial region AR1 and the second partial region AR2 without updating the third partial region AR3, from among the first through third partial regions AR1, AR2, and AR3 of the display panel 300, the host processor 100 may generate update image data UIMG by merging first image data A and second image data B that are to be respectively displayed in the first partial region AR1 and the second partial region AR2. The host processor 100 may transmit the update image data UIMG and a control signal CMD to the DDI 200. The control signal CMD may include a multiple partial update command MPUS and split information INFO_split about the update image data UIMG or the like.

The DDI 200 may receive the update image data UIMG and the control signal CMD, and if the received control signal CMD includes the multiple partial update command MPUS, the DDI 200 may split the update image data UIMG into first image data A and second image data B based on the split information INFO_split.

The DDI 200 may store the first image data A and the second image data B in a storage unit SU included therein. The storage unit SU may include at least one row corresponding to a row (or a horizontal line) of the display panel 300. The first image data A may be stored in a first storage region SR1 of the storage unit SU corresponding to the first partial region AR1. The second image B may be stored in a second storage region SR2 of the storage unit SU corresponding to the second partial region AR2. Accordingly, the first and second storage regions SR1 and SR2 of the storage unit SU may be updated with new data, that is, with the first image data A and the second image data B. A third storage region SR3 of the storage unit SU may maintain previous data.

The DDI 200 may drive the display panel 300 based on image data output from the storage unit SU in a current frame display period. Accordingly, each of the first partial region AR1 and the second partial region AR2 of the display panel 300 may be updated to an image corresponding to the first image data A and an image corresponding to the second image data B in a current frame. In the third partial region AR3 of the display panel 300, an image that was displayed in a previous frame may also be displayed in the current frame. According to another exemplary embodiment, other image data (e.g., black image data, white image data, image data of a predetermined color, predetermined image data, predetermined pattern data, null data, etc.) may be displayed in the third partial region AR3 or an illumination or power state for the third partial region AR3 may be set to a particular state (e.g., no illumination).

Referring to FIG. 3, according to the multiple partial update method of the present exemplary embodiment, first image data A and second image data B that are different from those of the previous frame may be respectively displayed in the first partial region AR1 and the second partial region AR2 of the current frame, and the same image data as that of the previous frame may be displayed in the third partial region AR3.

Meanwhile, although the first partial region AR1 and the second partial region AR2 are located on two sides of the display panel 300 and have same vertical size in FIG. 2, it is understood that one or more other exemplary embodiments are not limited thereto. If the first partial region AR1 and the second partial region AR2 are separate regions from each other, positions, sizes, and shapes of the first partial region AR1 and the second partial region AR2 may be modified in various manners.

Figure 4:
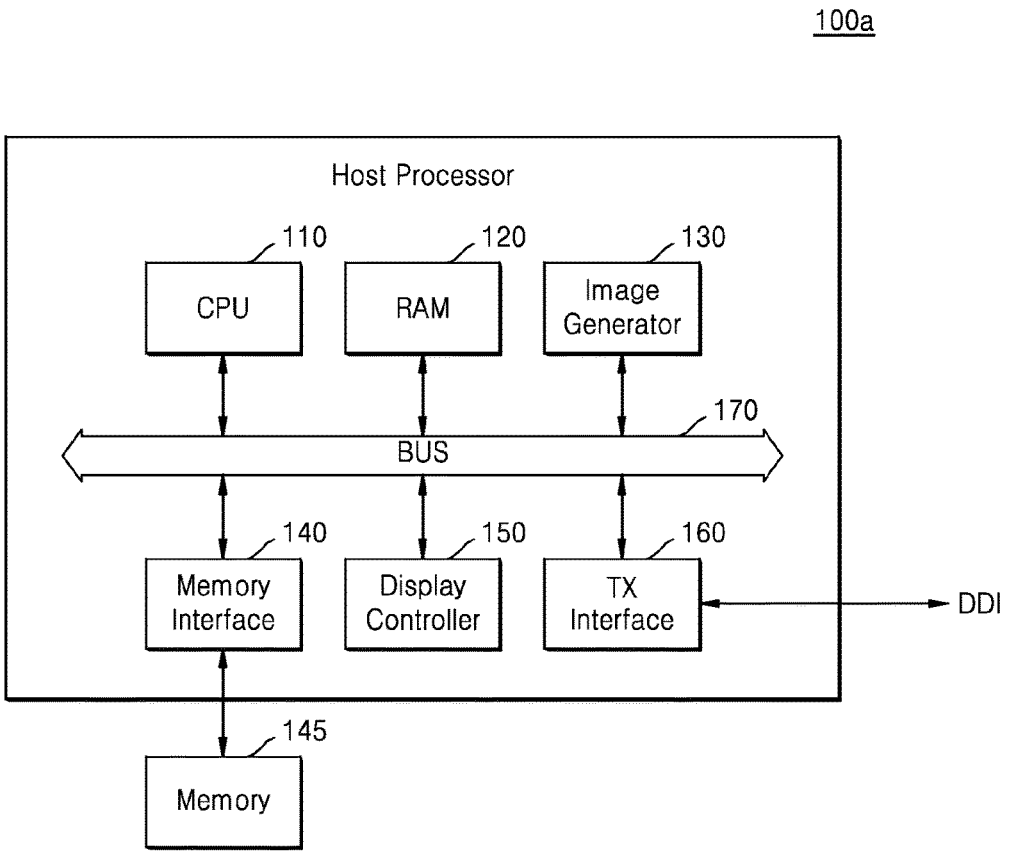
FIG. 4 is a block diagram illustrating a host processor according to an exemplary embodiment.

FIG. 4 is a block diagram illustrating a host processor 100*a* according to an exemplary embodiment. The host processor 100*a* is an example of the host processor 100 described with reference to FIGS. 1 and 2, and the above description of the host processor 100 may also apply to the host processor 100*a* of FIG. 4.

Referring to FIG. 4, the host processor 100*a* may include a central processing unit (CPU) 110, a random access memory (RAM) 120, an image generator 130, a memory interface 140, a display controller 150, and a transmission (TX) interface 160. Data communication between respective elements of the host processor 100*a* may be performed via a system bus 170.

The CPU 110 may control an overall operation of the host processor 100*a*. The CPU 110 may control operations of the respective elements, that is, the RAM 120, the image generator 130, the memory interface 140, the display controller 150, the transmission interface 160, and the system bus 170, and may request or control the display controller 150 to update the displayed image data. According to an exemplary embodiment, the CPU 110 may be a multi-core processor. The multi-core processor may be a single computing component having two or more independent cores.

The RAM 120 may store programs, instructions, parameters, or the like that are used for an operation of the host processor 100*a*. According to an exemplary embodiment, the RAM 120 may be a dynamic RAM (DRAM), a static RAM (SRAM), a read only memory (ROM), or the like.

The memory interface 140 is a block used to interface with a memory device 145. The memory interface 140 controls an overall operation of the memory device 145, and controls data exchange between the respective elements of the host processor 100*a* and the memory device 145. For example, the memory interface 140 may write data to the memory device 145 or read data from the memory device 145 according to a request by the CPU 110.

The memory device 145 is storage space for storing data, and may store an operating system (OS), various programs, and various data. The memory device 145 may be a DRAM, but is not limited thereto in one or more other exemplary embodiments. For example, the memory device 145 may be a non-volatile memory device (e.g., a flash memory, a phase-change RAM (PRAM), a magnetoresistive RAM (MRAM), a resistive RAM (ReRAM), or a ferroelectric RAM (FeFRAM)). While the memory device 145 is illustrated as being included outside the host processor 100*a* in the present exemplary embodiment, the memory device 145 may also be an internal memory included inside the host processor 100*a*.

The image generator 130 may read and execute programming instructions related to graphic processing. According to an exemplary embodiment, the image generator 130 may include at least one of a graphic engine, a graphic processing unit (GPU), a graphic accelerator, or the like.

The image generator 130 may generate or process image data according to control of the CPU 110. According to an exemplary embodiment, the image generator 130 may generate image data based on data read from the memory device 145.

According to the present exemplary embodiment, the image generator 130 may generate update image data UIMG by merging a plurality of image data, for example, first image data A and second image data B that are to be respectively displayed in the first partial region AR1 and the second partial region AR2 of the display panel 300 (see FIG. 2).

The display controller 150 controls an operation of the DDI 200 (see FIG. 1). The display controller 150 may generate control signals to control an operation of the DDI 200. According to an exemplary embodiment, the display controller 150 may determine an update condition of an image displayed on the display panel 300 and determine an operating mode of the DDI 200, for example, from among full update (in which the entire display region of the display panel is updated), partial update (in which one partial region is updated), and multiple partial update (in which multiple separated partial regions are updated). When multiple partial update is performed, the display controller 150 may generate, as a control signal, a multiple partial update command and split information about update image data. The split information may include setting information about the first partial region AR1 and the second partial region AR2. Alternatively, the split information may include setting information about the first storage region SR1 and the second storage region SR2 of the DDI 200 (see FIG. 2) corresponding to the first partial region AR1 and the second partial region AR2.

The display controller 150 may provide the transmission interface 160 with update image data and a control signal. The transmission interface 160 may be used to transmit to the DDI 200 (see FIG. 1) a control signal and a signal obtained by converting update image data, according to a set protocol. The transmission interface 160 may include at least one of a CPU interface, a red-green-blue (RGB) interface (e.g., component interface), a mobile industry processor interface (MIN), a mobile display digital interface (MDDI), a compact DisplayPort (CDP) interface, a mobile pixel link (MLP), a current mode advanced differential signaling (CMADS), a serial peripheral interface (SPI), an interIC (I2C) interface, a DisplayPort (DP) interface, a mini DP interface, an embedded displayport (eDP) interface, etc. In addition, the transmission interface 160 may be one of other high speed serial interfaces.

Figure 5A:
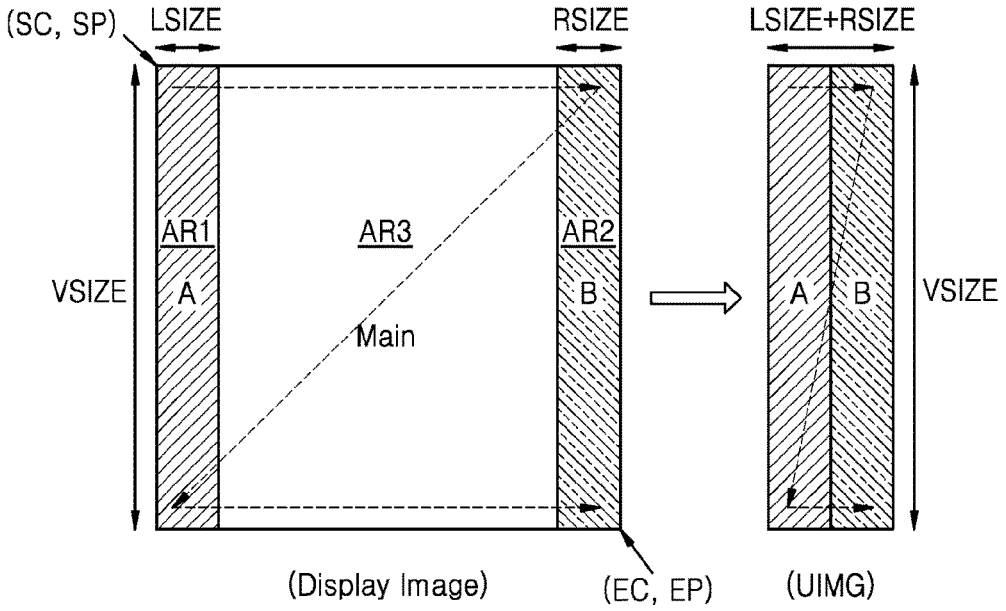
FIG. 5A illustrates an example of update image data generated by using a host processor according to a multiple partial update method according to an exemplary embodiment.
Figure 5B:
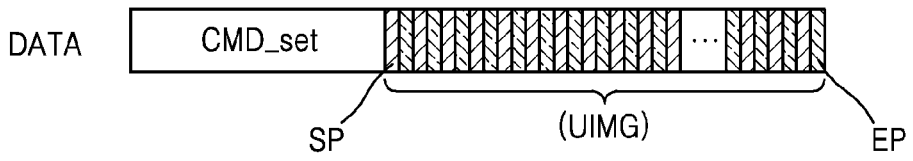
FIG. 5B illustrates data transmitted from the host processor to a display driver integrated circuit (DDI) according to an exemplary embodiment.

FIG. 5A illustrates an example of update image data generated by using a host processor 100 or 100*a* according to a multiple partial update method according to an exemplary embodiment, and FIG. 5B illustrates data transmitted from the host processor 100 or 100*a* to a DDI 200.

Referring to FIGS. 2 and 5A, the display panel 300 may include the first through third partial regions AR1, AR2, and AR3. The first partial region AR1 and the second partial region AR2 may be regions that are on the left and right of the display panel 300, respectively, and separate from each other, and the third partial region AR3 may be a center portion of the display panel 300.

The host processor 100 may generate update image data UIMG by merging image data A and B that are to be respectively displayed in the first partial region AR1 and the second partial region AR2. A vertical size of the update image data UIMG may be the same as a vertical size VSIZE of each of the first and second image data A and B, and a horizontal size of the update image data UIMG may be the same as a sum of a horizontal size LSIZE of the first image data A and a horizontal size RSIZE of the second image data B.

Meanwhile, update image data UIMG may be sequentially supplied from the host processor 100 to the display panel 300 in a direction in which the image data is displayed. The direction may be preset. The host processor 100 may generate update image data UIMG by considering the preset direction and provide the update image data UIMG to the DDI 200. For example, if image data is displayed on the display panel 300 in a downward direction, the host processor 100 may provide the DDI 200 with the update image data UIMG in row units in a downward direction. Here, image data corresponding to a row may be provided to the DDI 200 in a direction from the left to the right or from the right to the left, and the same direction may be applied to each row.

Referring to FIG. 5B, the host processor 100 may sequentially transmit a setting command signal CMD_set and update image data UIMG to the DDI 200. After the setting command signal CMD_set is transmitted to the DDI 200, the update image data UIMG may be transmitted to the DDI 200. Here, the setting command signal CMD_set may be a control signal CMD (see FIG. 2) including a multiple partial update command MPUS and setting information INFO_set or split information INFO_split about the first and second partial regions AR1 and AR2.

Meanwhile, the host processor 100 may transmit update image data UIMG in a preset direction as described above. The update image data UIMG may be sequentially transmitted to the DDI 200, from data of a start page SP to data of an end page EP. A page refers to a data unit corresponding to a row of the display panel 300, that is, line data. Pieces of data of the same page may be sequentially transmitted to the DDI 200 from a start column SC to an end column EC. Accordingly, as illustrated in FIGS. 5A and 5B, image data may be sequentially transmitted from a start page SP of the first image data A to an end page EP of the second image data B, and the first image data A and the second image data B may be alternately transmitted in row units.

Figure 6:
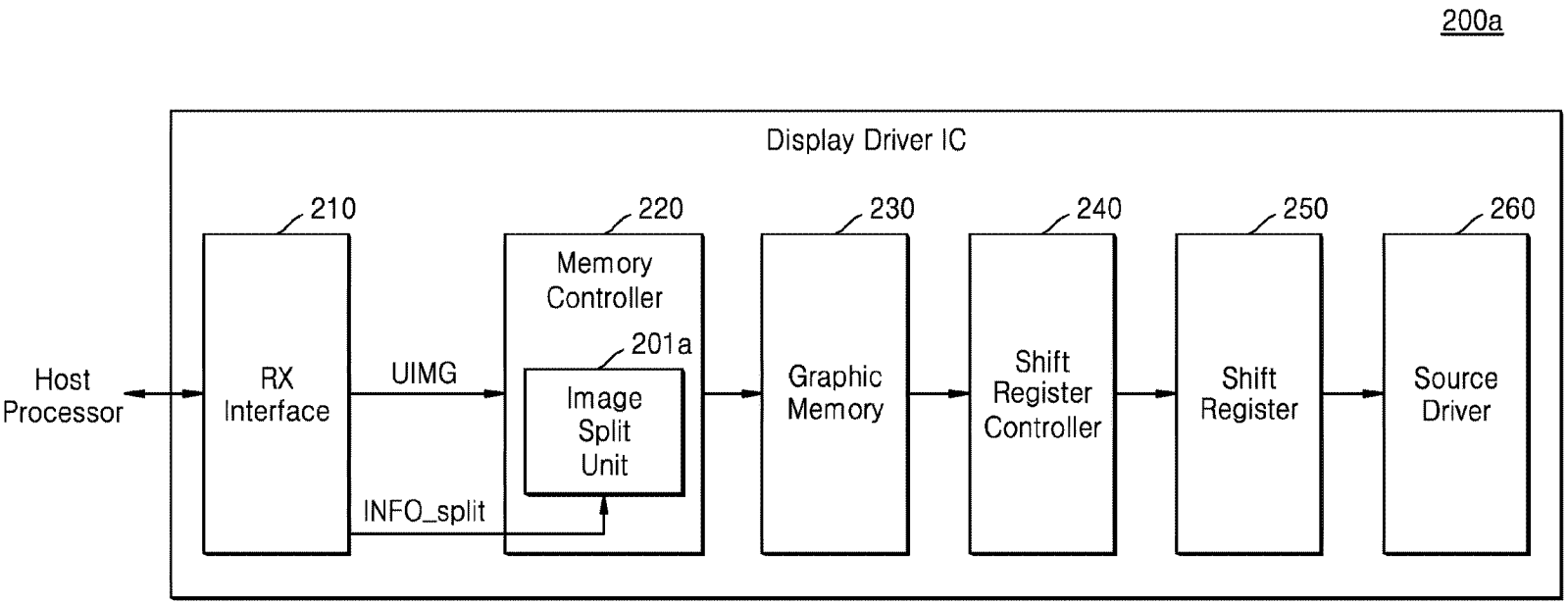
FIG. 6 is a block diagram illustrating a DDI according to an exemplary embodiment.

FIG. 6 is a block diagram illustrating a DDI 200*a* according to an exemplary embodiment.

Referring to FIG. 6, the DDI 200*a* may include a receive interface 210, a memory controller 220, a graphic memory 230, a shift register controller 240, a shift register 250, and a source driver 260.

The receive interface 210 may communicate with the outside, for example, a host processor 100 or 100*a* and may receive image data and a control signal from the host processor 100 or 100*a*. The receive interface 210 may be formed of or correspond to the same interface as the transmission interface 160 of the host processor 100*a* (FIG. 4).

According to the present exemplary embodiment, the receive interface 210 may process a signal received from the host processor 100 or 100*a* to generate or obtain update image data UIMG and split information INFO_split. For example, the receive interface 210 may obtain the update image data UIMG and the split information INFO_split from a control signal CMD received from the host processor 100 or 100*a*. The receive interface 210 may provide the memory controller 220 with the update image data UIMG and the split information INFO_split.

The memory controller 220 may control an access operation on the graphic memory 230, for example, a write operation of writing data to the graphic memory 230 and a reading operation of reading data from the graphic memory 230.

The memory controller 220 may include an image splitting unit 201*a* (e.g., image splitter). The image splitting unit 201*a* may split update image data UIMG into a plurality of image data based on split information INFO_split and control the plurality of image data such that the plurality of image data are respectively written to corresponding storage regions of the graphic memory 230.

The graphic memory 230 may store or output data according to control of the memory controller 220. The graphic memory 230 may be a frame memory that stores one frame of image data. The graphic memory 230 according to the present exemplary embodiment may store a plurality of image data according to control of the image splitting unit 201*a*. Thus, data of some of the plurality of storage regions included in the graphic memory 230, in which the plurality of image data are stored, may be updated, and other storage regions may maintain previously stored data.

The shift register controller 240 may control an operation of the shift register 250, and may provide the shift register 250 with row-unit data output from the graphic memory 230, that is, line data. Line data may be data corresponding to horizontal lines of the display panel 300.

The shift register 250 may shift line data transmitted via the shift register controller 240 according to control of the shift register controller 240. The shift register 250 may be a line memory. Furthermore, the shift register 250 may transmit the shifted line data to the source driver 260.

The source driver 260 may drive the display panel 300 based on the line data transmitted from the shift register 250. The source driver 260 may generate image signals according to a plurality of image data included in the line data, and may provide source lines of the display panel 300 with the image signals.

Figure 7:
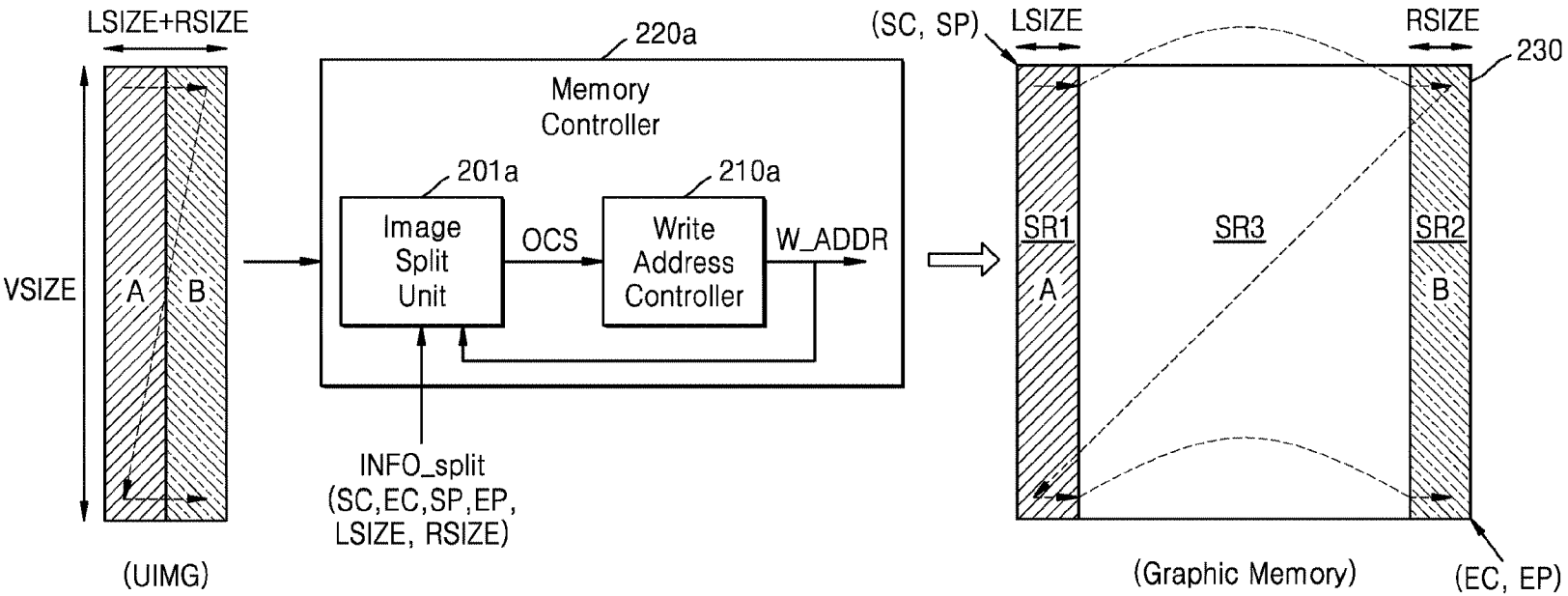
FIG. 7 illustrates a memory controller and an operation of the memory controller according to an exemplary embodiment.

FIG. 7 illustrates a memory controller 200*a* and an operation of the memory controller 200*a* according to an exemplary embodiment. The memory controller 220*a* of FIG. 7 is an exemplary embodiment of the memory controller 220 of FIG. 6.

Referring to FIG. 7, the memory controller 220*a* may store update image data UIMG in the graphic memory 230 in an order in which pieces of the update image data UIMG are input. The memory controller 220*a* may include an image splitting unit 201*a* (e.g., image splitter) and a write address controller 210*a*, and may provide the graphic memory 230 with a write address W_ADDR that is generated according to operations of the image splitting unit 201*a* and the write address controller 210*a* and input image data, thereby writing the update image data UIMG to the graphic memory 230.

The image splitting unit 201*a* may control the write address controller 210*a* such that the write address controller 210*a* generates a write address W_ADDR corresponding to storage regions in which update image data is to be stored, for example, to a first storage region SR1 and a second storage region SR2 in the case that the update image data is for the first partial region AR1 and the second partial region AR2.

In detail, the image splitting unit 201*a* may determine, in the graphic memory 230, storage regions in which update image data is to be stored, based on split information INFO_split, for example, the first storage region SR1 and the second storage region SR2.

Split information INFO_split may include setting information about the first storage region SR1 and the second storage region SR2 in which the first image data A and the second image data B are to be respectively stored. According to an exemplary embodiment, split information INFO_split may include address information of a minimum rectangular region including the first storage region SR1 and the second storage region SR2 and at least one of a vertical size and a horizontal size of the first storage region SR1 and the second storage region SR2. Here, the minimum rectangular region refers to a rectangular region of a smallest size that includes all of the partial storage regions for storing the update image data. The split information INFO_split may include size information and/or address information of the storage regions, as set forth above, and/or the partial regions of the image. For example, split information INFO_split may include a start column SC, a start page SP, an end column EC, an end page EP, a horizontal size LSIZE of the first storage region SR1, and a horizontal size RSIZE of the second storage region SR2.

The image splitting unit 201*a* may generate an offset control signal OCS indicating an offset between a received current write address W_ADDR and a write address W_ADDR, to which next writing is to be performed. The offset control signal OCS may indicate an address difference between the current write address W_ADDR, to which writing is currently being performed, and a write address W_ADDR, to which next writing is to be performed. The image splitting unit 201*a* may generate an offset control signal OCS such that a write address W_ADDR, to which next writing is to be performed, corresponds to an address regarding the first storage region SR1 and the second storage region SR2. For example, if the current write address W_ADDR indicates one of columns in the first storage region SR1, the image splitting unit 201*a* may generate an offset control signal OCS that sequentially increases addresses such that a next write address W_ADDR may sequentially indicate up to an end column EC1 of the first storage region SR1. When the current write address W_ADDR indicates the end column EC1 of the first storage region SR1, the image splitting unit 201*a* may generate, as an offset control signal OCS, an address difference between a start column SC2 of the second storage region SR2 and the end column EC1 of the first storage region SR1, so that a next write address W_ADDR indicates the start column SC2 of the second storage region SR2.

The write address controller 210*a* may generate a write address W_ADDR according to control of the image splitting unit 201*a*. The write address controller 210*a* may generate a write address W_ADDR corresponding to storage regions that are separate based on an offset control signal OCS, for example, the first storage region SR1 and the second storage region SR2.

The graphic memory 230 may move a write pointer according to a write address W_ADDR and write received data in a storage location indicated by the write pointer. Accordingly, the update image data UIMG is split into first image data A and second image data B to be respectively stored in the first storage region SR1 and the second storage region SR2 of the graphic memory 230.

Figure 8:
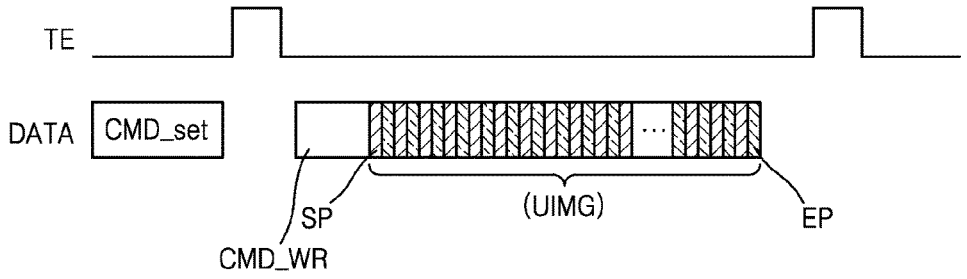
FIG. 8 illustrates signals exchanged between the DDI and the host processor, according to an exemplary embodiment.

FIG. 8 illustrates signals exchanged between the DDI 200*a* of FIG. 6 and the host processor 100*a* of FIG. 4, according to an exemplary embodiment.

Referring to FIG. 8, the host processor 100*a* may transmit a setting command signal CMD_set to the DDI 200*a*. The setting command signal CMD_set may include a multiple partial update command MPUS and setting information INFO_set or split information INFO_split about partial regions AR1 and AR2 (for example, a column address or a page address).

The DDI 200*a* may transmit a tearing effect (TE) signal TE to the host processor 100*a*. The TE signal TE is a signal for preventing tearing effects of an image displayed on the display panel 300, and is used to control a transmission timing of image data to be transmitted from the host processor 100*a* to the DDI 200*a*.

The host processor 100*a* may transmit a write command CMD_WR and update image data UIMG to the DDI 200*a* in response to the TE signal TE. The host processor 100*a* may transmit update image data UIMG in units of transmission according to a set interface method. When the update image data UIMG as illustrated in FIG. 7, which includes the first image data A and the second image data B, is transmitted, the first image data A and the second image data B may be alternately transmitted in row units.

FIGS. 9A and 9B illustrate tables showing protocols for a setting command signal CMD_set and command set parameters according to one or more exemplary embodiments. In particular, FIG. 9A is a table showing commands and parameters included in a setting command signal CMD_set, and FIG. 9B is a table showing column address setting commands and parameters according to an exemplary embodiment.

Referring to FIG. 9A, a setting command signal CMD_set according to the present exemplary embodiment may include a column address setting command Set_CA, a page address setting command Set_PA, and parameters related to setting of a column address and a page address.

When update image data UIMG includes the first and second image data A and B and the first and second image data A and B are respectively stored in the first and second storage regions SR1 and SR2 disposed on two sides of the graphic memory 230 as illustrated in FIG. 7, a column address setting parameter may include a start column SC and an end column EC of a minimum rectangular region including the first and second storage regions SR1 and SR2, a dual signal (e.g., parameter) DUAL indicating that image data update is a multiple partial update, a horizontal size LSIZE of the first storage region SR1, and a horizontal size RSIZE of the second storage region SR2.

A page address setting parameter may include a start page SP and an end page EP of the minimum rectangular region including the first and second storage regions SR1 and SR2.

When the host processor 100*a* (FIG. 4) and the DDI 200*a* (FIG. 6) communicate with each other according to the MIPI method, and data is updated with respect to one storage region of the graphic memory 230, a setting command signal CMD_set may include a column address setting command Set_CA and a page address setting command Set_PA, a column address setting parameter may include a start column SC and an end column EC, and a page address setting parameter may include a start page SP and an end page EP.

According to an exemplary embodiment, when data is updated with respect to two storage regions, for example, the first storage region SR1 and the second storage region SR2, column address setting parameters such as a dual signal DUAL or horizontal sizes LSIZE and RSIZE of the first and second storage regions SR1 and SR2 or the like may be added to the setting command signal CMD_set for one storage region to set the two storage regions.

Referring to FIG. 9B, the host processor 100*a* (FIG. 4) may set a column address setting command and parameters of the command to 8-bit digital data (D7 to D0). According to MIPI specifications, a column address setting command Set_CA (FIG. 9A) is 0x2AHex (hexadecimal 2A), and first and second parameters 1st para and 2nd para may include data indicating a start column SC, and third and fourth parameters 3rd para and 4th para may include data indicating an end column EC.

When data is updated with respect to two storage regions according to a multiple partial update method of an exemplary embodiment, as illustrated in FIG. 9B, fifth through seventh parameters 5th para, 6th para, and 7th para may be added. The fifth parameter 5th para may include data about a dual signal DUAL. The dual signal DUAL may be represented by, for example, 0x01Hex (hexadecimal value 1). A sixth parameter 6th para and a seventh parameter 7th para may include data indicating a horizontal size of the two storage regions.

Figure 10:
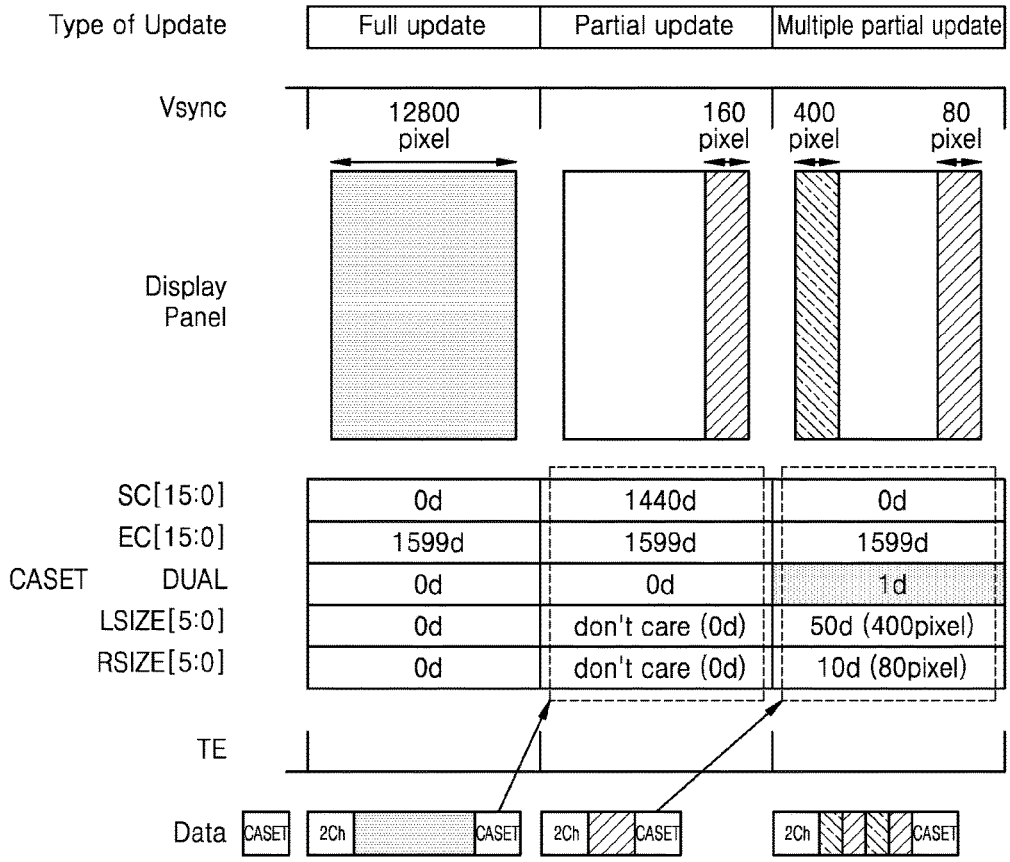
FIG. 10 illustrates a protocol setting with respect to various update methods.

FIG. 10 illustrates a protocol setting of FIG. 9B with respect to various update methods. In the exemplary embodiments of FIG. 10, protocol settings for a page address, in other words a row address, with respect to various update methods are same. Therefore, FIG. 10 illustrates a protocol setting for the column address.

Referring to FIG. 10, a protocol setting according to an exemplary embodiment regarding full update, partial update, and multiple partial update is shown. It is assumed here, without limitation, that a horizontal resolution of a display panel is 12800 pixels (1600*8 pixels), and each column address indicates an address for 8 pixels. Accordingly, the display panel and a graphic memory corresponding to the display panel may have 1600 column addresses.

When full update is performed, that is, when the entire display panel is updated, start column data (SC[15:0]) is set to 0d (decimal value 0), and end column data (EC[15:0]) is set to 1599d (decimal value 1599) so that the entire display panel may be set as an update region. All the other parameters (DUAL, LSIZE[5:0], RSIZE[5:0]) except the start column data (SC[15:0]) and the end column data (EC[15:0]) may be set to 0d.

Furthermore, when partial update is performed, that is, when a partial region of a display panel is updated without updating the entire display panel, start column data (SC[15:0]) and end column data (EC[15:0]) may be set. When partial update on a partial region that is on the right side of the display panel and has a horizontal resolution of 160 pixels is performed, start column data (SC[15:0]) may be set to 1440d, and end column data (EC[15:0]) may be set to 1599d. All the other parameters (DUAL, LSIZE[5:0], RSIZE[5:0]) except the start column data (SC[15:0]) and the end column data (EC[15:0]) may be set to 0d.

When multiple partial update is performed, that is, for example, when two partial regions of a display panel are updated without updating the entire display panel, a protocol may be set as follows. Start column data (SC[15:0]) and end column data (EC[15:0]) of a minimum rectangular region including two partial regions to be updated may be set, a parameter indicating multiple partial update may be set, and the size of the two partial regions, for example, horizontal resolution, may be set. When an update is performed on a partial region that is on the left side of the display panel and has a horizontal resolution of 400 pixels and a partial region that is on the right side of the display panel and has a horizontal resolution of 80 pixels, start column data (SC[15:0]) may be set to 0d, and end column data (EC[15:0]) may be set to 1599d. Also, a dual signal DUAL may be set to 1d to thereby indicate that current data update is an update with respect to two partial regions, and horizontal sizes (LSIZE[5:0] and RSIZE[5:0]) of the two regions may be set to 50d and 10d, respectively.

As described above, various update methods may be used by variously setting the values of parameters with respect to the protocol of FIG. 9B. However, it is understood that the parameters set forth in the protocols of FIGS. 9A and 9B are only exemplary, and one or more other exemplary embodiments are not limited thereto. That is, in various exemplary embodiments, the parameters of the command signal CMD_set may include any combination and variety of information to define the partial regions of the storage and/or of the display panel. Furthermore, according to another exemplary embodiment, where multiple partial regions have a same shape and size, parameters or information regarding the shape and size of only one among these multiple partial regions may be provided. Additionally, it is understood that a control signal received by the DDI 200 from the host processor 100 may include a parameter (e.g., DUAL) that indicates whether the update is a full update, a partial region update, or a multiple partial update.

FIGS. 11A and 11B illustrate tables showing protocols for a setting command signal CMD_set according to exemplary embodiments.

Referring to FIG. 11A, a setting command signal CMD_set may include a first multiple column address setting command Set_MPUCA1 and parameters of the same. The parameters of the first multiple column address setting command Set_MPUCA1 may include a start column SC, an end column EC, and horizontal sizes LSIZE and RSIZE of two storage regions.

The setting command signal CMD_set may also include a page address setting command Set_PA and parameters of the same, which are the same as or similar to those described above with reference to FIG. 9A, and thus a redundant description thereof will be omitted below.

Referring to FIG. 11B, a setting command signal CMD_set may include a second multiple column address setting command Set_MPUCA2, a page address setting command Set_PA, and parameters of the same. The parameters of the second multiple column address setting command Set_MPUCA2 may include a start column SC1 and an end column EC1 about a first storage region and a start column SC2 and an end column EC2 about a second storage region.

The setting command signal CMD_set may also include a page address setting command Set_PA and parameters of the same, which are the same as or similar to those described above with reference to FIG. 9A, and thus a redundant description thereof will be omitted below.

Figure 12A:
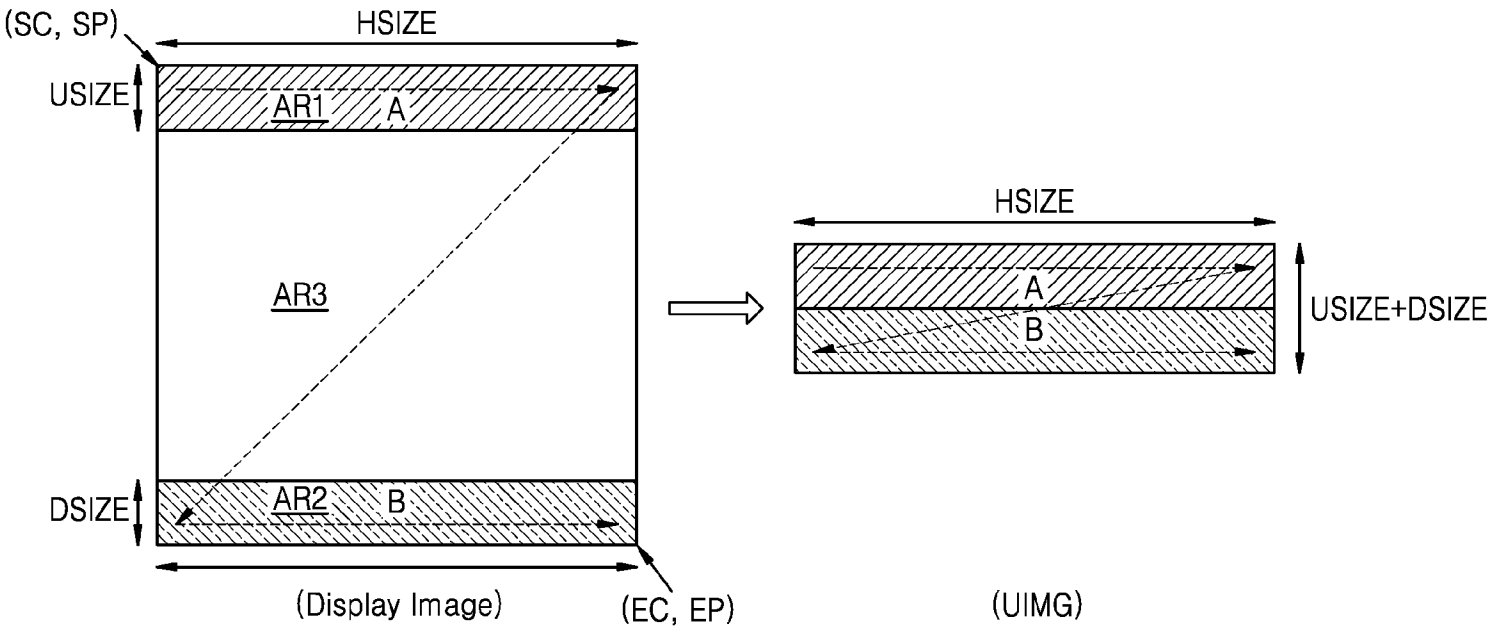
FIG. 12A illustrates an example of update image data generated by using a host processor according to a multiple partial update method according to another exemplary embodiment.

FIG. 12A illustrates an example of update image data generated or obtained by using a host processor 100 or 100*a* according to a multiple partial update method according to another exemplary embodiment.

Referring to FIG. 12A, the display panel 300 (FIG. 2) may include first through third partial regions AR1, AR2, and AR3. The first partial region AR1 and the second partial region AR2 may be regions on and under the display panel 300, and are separate from each other, and the third partial region AR3 may be a center portion of the display panel 300.

The host processor 100 or 100*a* may generate update image data UIMG by merging first image data A and second image data B that are respectively to be displayed in the first partial region AR1 and the second partial region AR2. A vertical size of the update image data UIMG may be the same as a sum of a vertical size USIZE of the first image data A and a vertical size DSIZE of the second image data B, and a horizontal size of the update image data UIMG may be the same as a horizontal size HSIZE of each of the first and second image data A and B. The host processor 100 or 100*a* may transmit the update image data UIMG to the DDI 200 in a direction illustrated in FIG. 12A.

FIG. 12B is a table showing a protocol for a setting command signal CMD_set according to the multiple partial update method of FIG. 12A. The protocol of FIG. 12B includes a setting command signal CMD_set used to split the update image data UIMG of FIG. 12A to store the same in the graphic memory 230 (FIG. 6). A setting command signal CMD_set may include a column address setting command Set_CA, a page address setting command Set_PA, and parameters related to setting of a column address and a page address.

A column address setting parameter may include a start column SC and an end column EC of a minimum rectangular region including first and second storage regions in the graphic memory 230, in which first image data A and the second image data B are to be respectively stored.

A page address setting parameter may include a start page SP and an end page EP of the minimum rectangular region including the first and second storage regions, a dual signal DUAL indicating that current data update is a data update with respect to two regions, a vertical size USIZE of the first storage region, and a vertical size DSIZE of the second storage region.

Figure 13A:
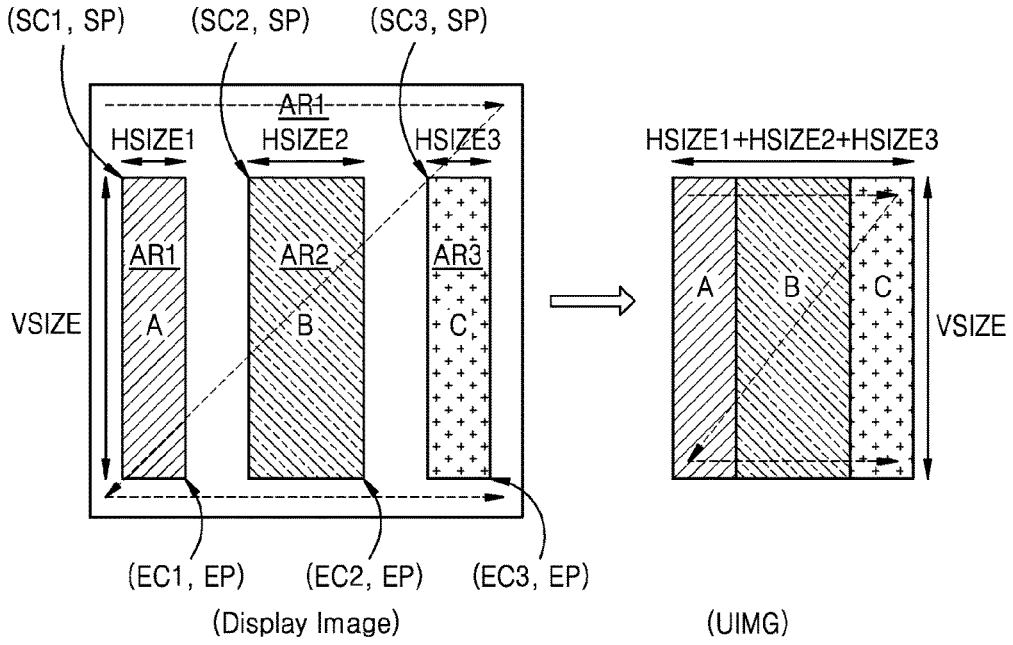
FIG. 13A illustrates an example of update image data generated by using a host processor according to a multiple partial update method according to another exemplary embodiment.

FIG. 13A illustrates an example of update image data generated or obtained by using a host processor 100 or 100*a* according to a multiple partial update method according to another exemplary embodiment.

Referring to FIG. 13A, a display panel 300 may include first through fourth partial regions AR1, AR2, AR3, and AR4. The first through third partial regions AR1, AR2, and AR3 may be regions that are separate from one another and where an image is updated, and the fourth partial region AR4 may be a region where an image is not updated. The first through third partial regions AR1, AR2, and AR3 may have the same vertical size VSIZE.

The host processor 100 or 100*a* may generate update image data UIMG by merging first through third image data A, B, and C that are to be respectively displayed in the first through third partial regions AR1, AR2, and AR3. A vertical size of the update image data UIMG may be the same as the vertical size VSIZE of each of the first through third image data A, B, and C, and a horizontal size of the update image data UIMG may be the same as a sum of a horizontal size HSIZE1 of the first image data A, a horizontal size HSIZE2 of the second image data B, and a horizontal size HSIZE3 of the third image data C.

The host processor 100 or 100*a* may transmit the update image data UIMG to the DDI 200 in a direction illustrated in FIG. 13A.

FIG. 13B is a table showing a protocol for a setting command signal CMD_set according to the multiple partial update method of FIG. 13A. The protocol of FIG. 13B includes a setting command signal CMD_set used to split the update image data UIMG of FIG. 13A to store the same in the graphic memory 230 (FIG. 6). The setting command signal CMD_set may include a third column address setting command Set_MPUCA3 according to multiple partial update, a page address setting command Set_PA, and parameters of the commands. The parameters of the third column address setting command Set_MPUCA3 may include the number (NPA[1:0]) of update regions, start columns SC1, SC2, and SC3 of first through third regions, in which the first through third image data A, B, and C are to be respectively stored, and horizontal sizes HSIZE1, HSIZE2, HSIZE3 of the first through third storage regions. The number (NPA[1:0]) of update regions may be set based on the number of partial regions that are updated. In the present exemplary embodiment, the number (NPA[1:0]) of update regions may be set to 2d.

The page address setting command Set_PA may include a start page SP and an end page EP of a minimum rectangular region including the first through third storage regions.

Meanwhile, although it is assumed in the exemplary embodiments of FIGS. 13A and 13B that three partial regions are updated, it is understood that one or more other exemplary embodiments are not limited thereto. A display panel may include at least three partial regions, and at least two partial regions may be updated. It is understood that the parameters of FIG. 13B may be modified according to the number of partial regions that are updated.

Figure 14A:
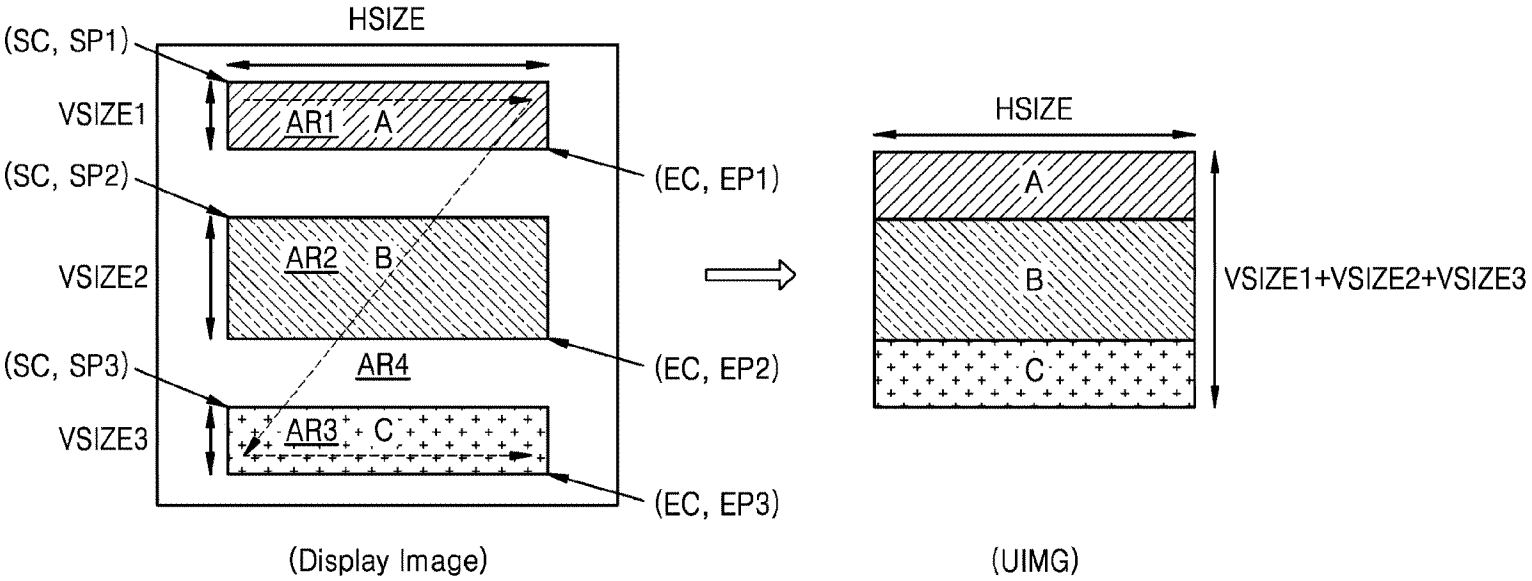
FIG. 14A illustrates an example of update image data generated by using a host processor according to a multiple partial update method according to another exemplary embodiment.

FIG. 14A illustrates an example of update image data generated or obtained by using a host processor 100 or 100*a* according to a multiple partial update method according to another exemplary embodiment.

Referring to FIG. 14A, a display panel 300 may include first through fourth partial regions AR1, AR2, AR3, and AR4. The first through third partial regions AR1, AR2, and AR3 may be regions that are separate from one another and where an image is updated, and the fourth partial region AR4 may be a region where an image is not updated. The first through third partial regions AR1, AR2, and AR3 may have the same horizontal size HSIZE.

The host processor 100 or 100*a* may generate update image data UIMG by merging first through third image data A, B, and C that are to be respectively displayed in the first through third partial regions AR1, AR2, and AR3. A vertical size of the update image data UIMG may be the same as a sum of a vertical size VSIZE1 of the first image data A, a vertical size VSIZE2 of the second image data B, and a vertical size VSIZE3 of the third image data C. A horizontal size of the update image data UIMG may be the same as the horizontal HSIZE of each of the first through third image data A, B, and C.

The host processor 100 or 100*a* may transmit the update image data UIMG in a direction illustrated in FIG. 14A.

FIG. 14B is a table showing a protocol for a setting command signal CMD_set according to the multiple partial update method of FIG. 14A. The protocol of FIG. 14B includes a setting command signal CMD_set used to split the update image data UIMG of FIG. 14B to store the same in the graphic memory 230 (FIG. 6). A setting command signal CMD_set may include a column address setting command Set_CA according to multiple partial update, a first multiple page address setting command Set_MPUPA1, and parameters of the commands. The column address setting command Set_CA may include a start column SC and an end column EC of a minimum rectangular region including the first through third storage regions.

The parameters of the first multiple page address setting command Set_MPUPA1 may include the number (NPA[1:0]) of update regions, start pages SP1, SP2, and SP3 of the first through third storage regions in which the first through third image data A, B, and C are to be respectively stored, and vertical sizes VSIZE1, VSIZE2, VSIZE3 of the first through third regions. The number (NPA[1:0]) of update regions may be set based on the number of partial regions that are updated. In the present exemplary embodiment, the number (NPA[1:0]) of update regions may be set to 2d.

Meanwhile, although it is assumed in the exemplary embodiments of FIGS. 14A and 14B that three partial regions are updated, it is understood that one or more other exemplary embodiments are not limited thereto. A display panel may include at least three partial regions, and at least two partial regions may be updated. It is understood that the parameters of FIG. 14B may be modified according to the number of partial regions that are updated.

Figure 15A:
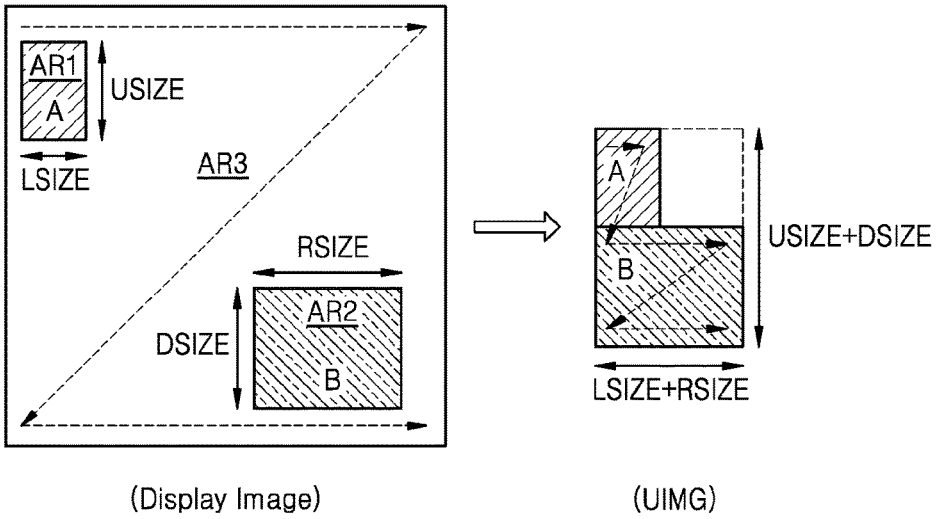
FIG. 15A illustrates an example of update image data generated by using a host processor according to a multiple partial update method according to another exemplary embodiment.

FIG. 15A illustrates an example of update image data generated or obtained by using a host processor 100 or 100*a* according to a multiple partial update method according to another exemplary embodiment.

Referring to FIG. 15A, a display panel 300 may include first through third partial regions AR1, AR2, and AR3. The first and second partial regions AR1 and AR2 may be regions that are separate from each other and where an image is updated, and the third partial region AR3 may be a region where an image is not updated. The first and second partial regions AR1 and AR2 may have different vertical sizes and different horizontal sizes.

The host processor 100 or 100*a* may generate update image data UIMG by merging image data A and B that are respectively to be displayed in the first partial region AR1 and the second partial region AR2. A vertical size of the update image data UIMG may be the same as a sum of a vertical size USIZE of the first image data A and a vertical size DSIZE of the second image data B. A horizontal size of the update image data UIMG may be the same as the longer one of a horizontal size LSIZE of the first image data A and a horizontal size RSIZE of the second image data B. Referring to FIG. 15A, the horizontal size RSIZE of the second image data B is longer than the horizontal size LSIZE of the first image data A. Thus, the horizontal size of the update image data UIMG may be the same as the horizontal size RSIZE of the second image data B.

FIG. 15B is a table showing a protocol for a setting command signal CMD_set according to the multiple partial update method of FIG. 15A. The protocol of FIG. 15B includes a setting command signal CMD_set used to split the update image data UIMG of FIG. 15B to store the same in the graphic memory 230 (FIG. 6). The setting command signal CMD_set may include a fourth multiple column address setting command Set_MPUCA4, a fourth multiple page address setting command Set_MPUPA4, and parameters of the commands. The parameters of the fourth multiple column address setting command Set_MPUCA4 may include a start column SC and an end column EC of a minimum rectangular region including the first and second storage regions in which the first image data A and the second image data B are to be respectively stored and the horizontal sizes LSIZE and RSIZE of the first and second storage regions.

The parameters of the fourth multiple column address setting command Set_MPUCA4 may include a start page SP and an end page EP of a minimum rectangular region including the first and second storage regions with respect to the update regions, and respective vertical sizes USIZE and DSIZE of the first and second storage regions.

Various multiple partial update methods and protocols according to the methods based on the number and locations of partial regions to be updated have been described above with reference to FIGS. 12A and 12B, 13A and 13B, 14A and 14B, and 15A and 15B. However, it is understood that one or more other exemplary embodiments are not limited thereto, and may include any combination and variety of parameters from which sizes, shapes, and/or positions of partial regions to be updated may be determined.

Figure 16:
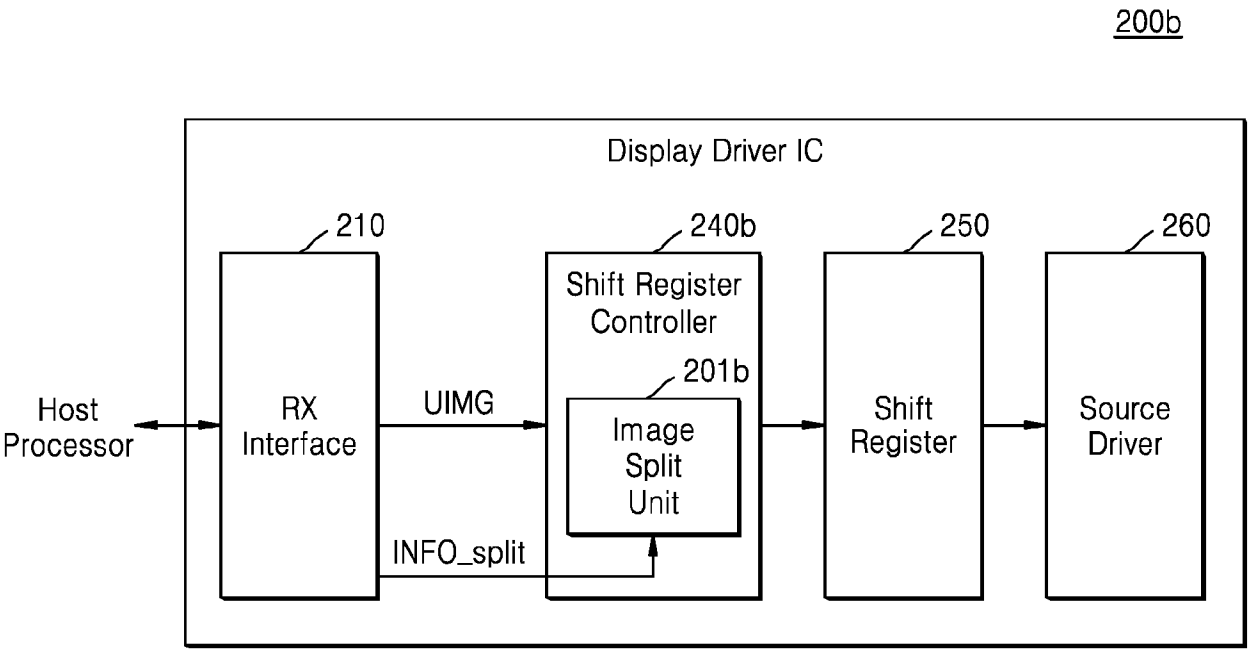
FIG. 16 is a block diagram illustrating a DDI according to another exemplary embodiment.

FIG. 16 is a block diagram illustrating a DDI 200*b* according to another exemplary embodiment.

Referring to FIG. 16, the DDI 200*b* may include a receive (RX) interface 210, a shift register controller 240*b*, a shift register 250, and a source driver 260.

The shift register controller 240*b* may include an image splitting unit 201*b* (e.g., image splitter). The image splitting unit 201*b* may split update image data UIMG into a plurality of image data and provide the plurality of image data in line units to some register units included in the shift register 250. An operation of the shift register controller 240*b* will be described in more detail below with reference to FIG. 17.

Figure 17:
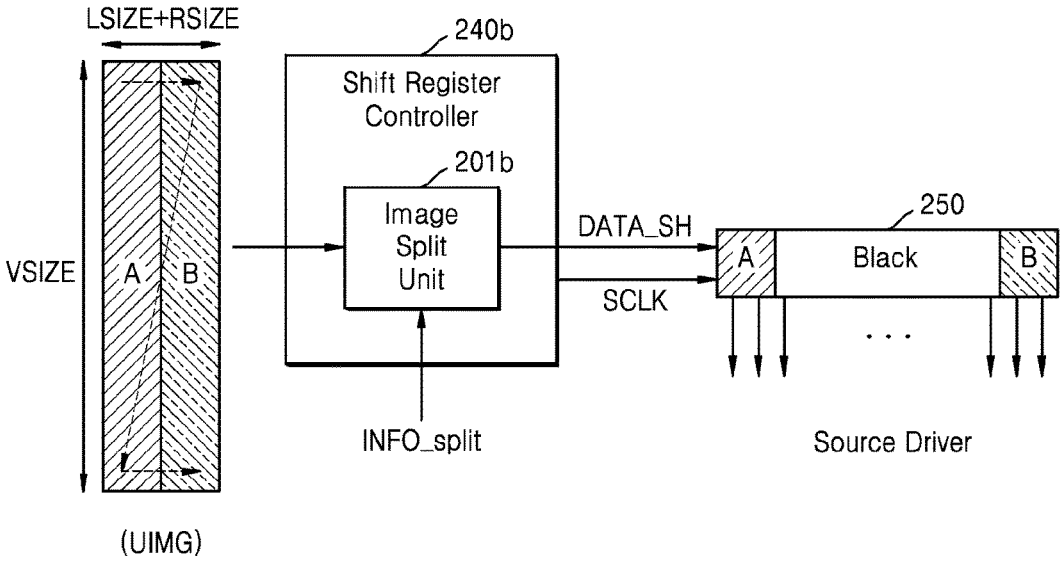
FIG. 17 is a view for explaining an operation of a shift register controller according to an exemplary embodiment.

FIG. 17 is a view for explaining an operation of the shift register controller 240*b* according to an exemplary embodiment.

Referring to FIG. 17, the shift register controller 240*b* may provide the shift register 250 with a shift clock SCLK and shift data DATA_SH. The shift data DATA_SH may be line data (or page data) corresponding to a line of the display panel 300. The shift register 250 may shift the transmitted shift data DATA_SH according to the shift clock SCLK.

Meanwhile, the image splitting unit 201*b* may determine, based on split information INFO_split, register units, in which the first image data A and the second image data B are respectively to be stored, from among register units included in the shift register 250. The image splitting unit 201*b* may provide the shift register 250 with pieces of update image data UIMG that are sequentially transmitted in line units, as shift data DATA_SH, and may here adjust a time when providing the same. Preset data, for example, data indicating a black color, may be provided to the shift register 250 as shift data DATA_SH in a time period where update image data UIMG is not provided to the shift register 250. Accordingly, the first image data A and the second image data B may be separately stored in the shift register 250.

As described above, line data including image data to be updated may be stored in the shift register 250, and the shift register 250 may transmit the stored line data to the source driver 260.

Figure 18:
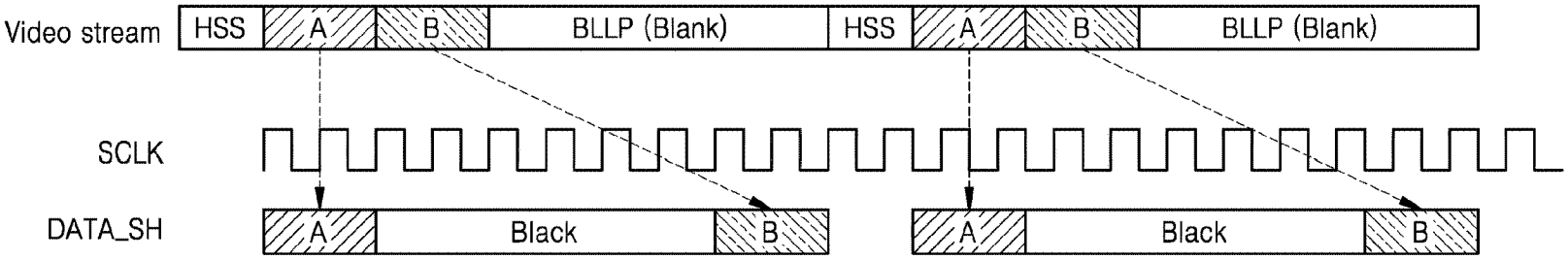
FIG. 18 illustrates data provided to the DDI of FIG. 16 and line data stored in the shift register of FIG. 16.

FIG. 18 illustrates data provided to the DDI 200*b* of FIG. 16 and line data stored in the shift register 250 of FIG. 16.

Referring to FIG. 18, the DDI 200*b* may receive a video stream including image data from the host processor 100*a*. A video stream may include a horizontal synchronization signal HSS and line data of update image data UIMG. After the horizontal synchronization signal HSS is transmitted, the update image data UIMG may be transmitted in line units. For example, first line data of the update image data UIMG may be transmitted after the horizontal synchronization signal HSS is transmitted, and then a next horizontal synchronization signal HSS may be transmitted, and next line data of the update image data UIMG, that is, second line data may be transmitted. When the update image data UIMG illustrated in FIG. 17 is transmitted to the DDI 200*b*, after line data of the first image data A is transmitted, line data of the second image data B may be transmitted. Here, there is an extra time period BLLP after the line data of the second image data B is transmitted and before a next horizontal synchronization signal HSS is transmitted. In this extra time period BLLP, no data may be transmitted or a signal indicating a low power mode and invalid data may be transmitted together.

As described above with reference to FIG. 17, according to control of the image splitting unit 201*b* of FIG. 17, the received update image data UIMG may be provided to the shift register 250 as shift data DATA_SH. As a time of providing the update image data UIMG is adjusted, the first image data A and the second image data B may be split and stored in the shift register 250. When line data is stored in the shift register 250, the shift register 250 transmits the stored line data to the source driver 260. Next line data of the update image data UIMG may be provided to the shift register 250 as shift data DATA_SH and stored in the shift register 250.

Figure 19:
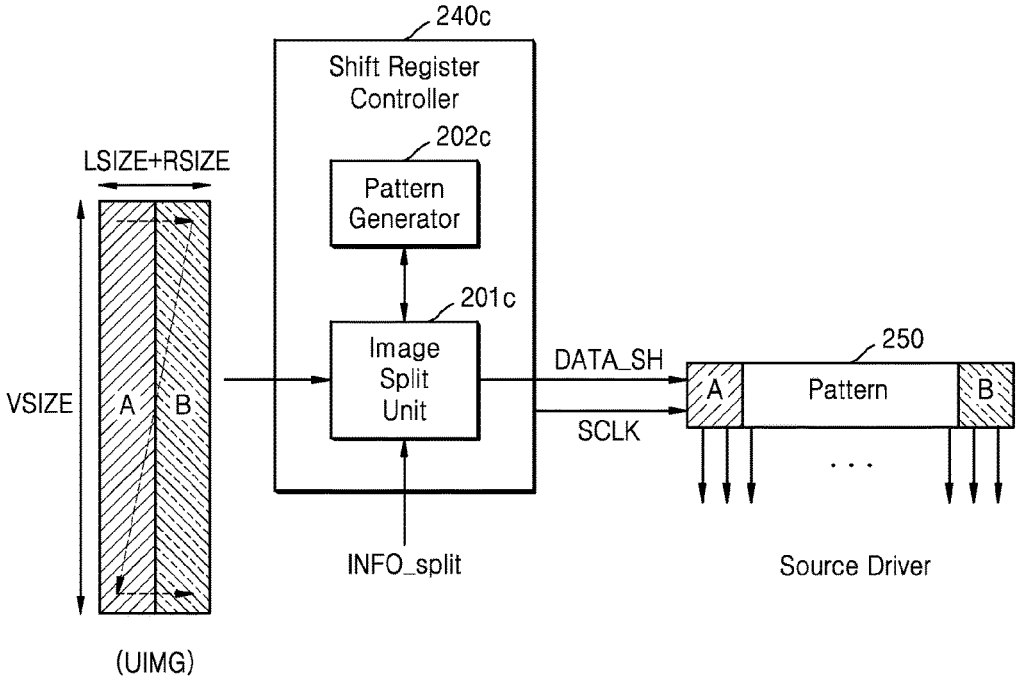
FIG. 19 is a view for explaining a shift register controller and an operation of the shift register controller according to another exemplary embodiment.

FIG. 19 is a view for explaining a shift register controller 240*c* and an operation of the shift register controller 240*c* according to another exemplary embodiment.

Referring to FIG. 19, the shift register controller 240*c* may include an image splitting unit 201*c* (e.g., image splitter) and a pattern generator 202*c*.

As described above with reference to FIG. 17, the image splitting unit 201*c* may determine, based on split information INFO_split, register units, in which the first image data A and the second image data B are respectively to be stored, from among register units included in the shift register 250. The image splitting unit 201*c* may provide the shift register 250 with pieces of update image data UIMG that are sequentially transmitted in line units, as shift data DATA_SH, and may adjust a time of the providing. Accordingly, the first image data A and the second image data B may be separately stored in the shift register 250.

The image splitting unit 201*c* may access the pattern generator 202*c* to read pattern data, and may provide the shift register 250 with the read pattern data as shift data DATA_SH, in a time period where update image data UIMG is not provided to the shift register 250. Accordingly, the first image data A is stored in some register units of the shift register 250, the second image data B is stored in some other register units of the shift register 250, and pattern data may be stored in the rest of or remaining register units.

Line data including image data to be updated and pattern data may be stored in the shift register 250, and the shift register 250 may transmit the stored line data to the source driver 260.

Figure 20:
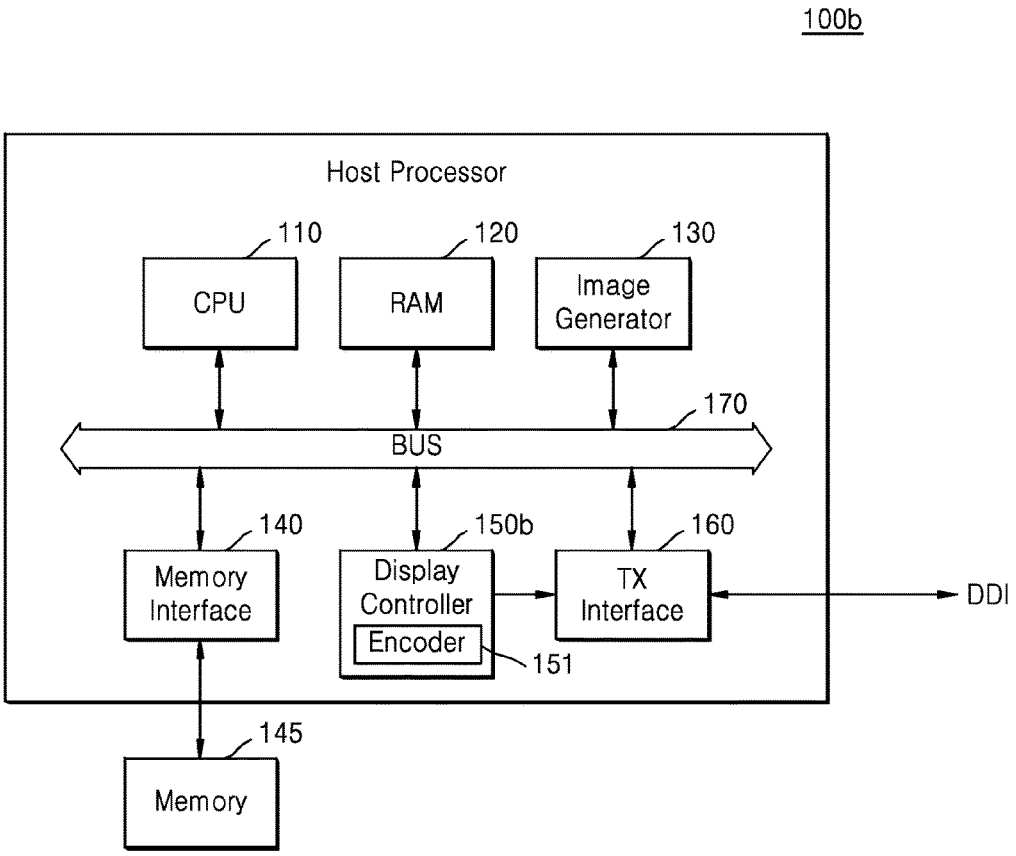
FIG. 20 is a block diagram illustrating a host processor according to another exemplary embodiment.

FIG. 20 is a block diagram illustrating a host processor 100*b* according to another exemplary embodiment.

Referring to FIG. 20, the host processor 100*b* may include a CPU 110, a RAM, an image generator 130, a memory interface 140, a display controller 150*b*, and a transmission (TX) interface 160. Data communication between respective elements of the host processor 100*b* may be performed via a system bus 170.

The display controller 150*b* may include an encoder 151. The encoder 151 may compress image data provided from the image generator 130, for example, update image data. The display controller 150*b* may transmit the compressed update image data through the transmission interface 160. As the transmitted data is compressed, a transmission data amount is reduced, thereby reducing power consumption of data transmission.

Other elements other than the display controller 150*b* operate in the same manner as or similar to those corresponding elements of the host processor 100*b* of FIG. 4, and thus a redundant description thereof will be omitted below.

Figure 21:
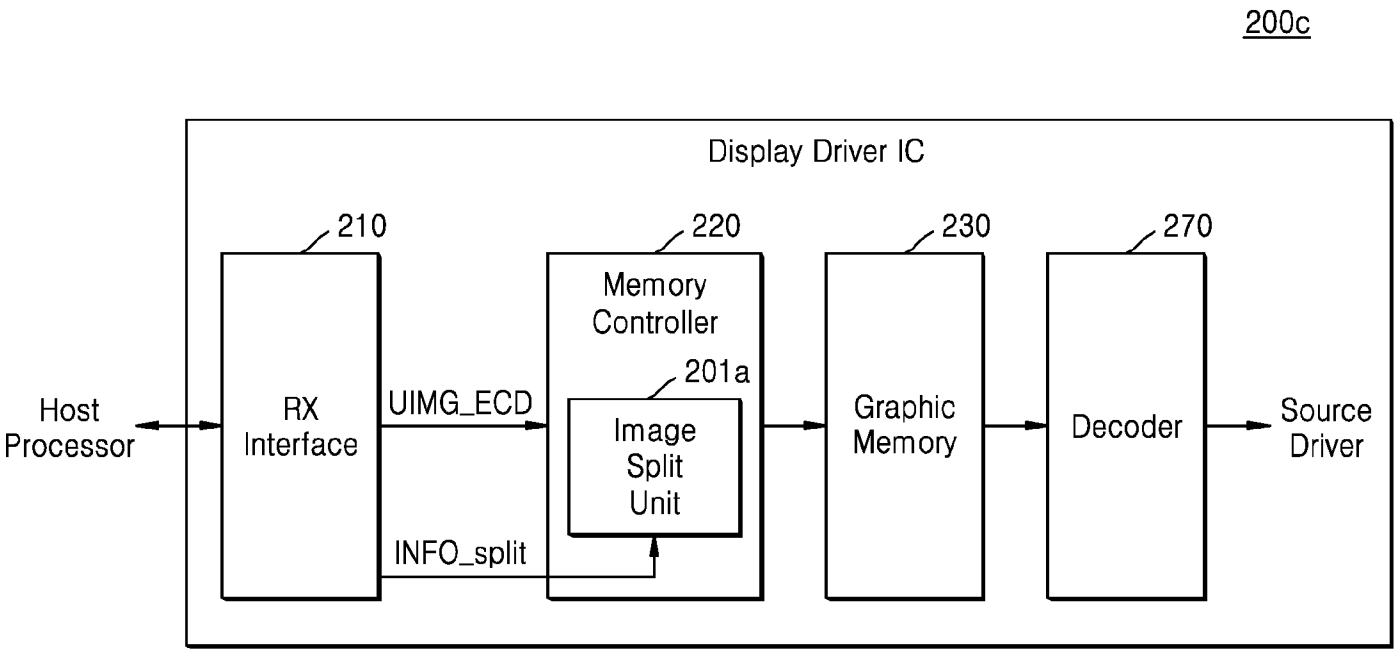
FIG. 21 is a block diagram illustrating a DDI according to another exemplary embodiment.

FIG. 21 is a block diagram illustrating a DDI 200*c* according to another exemplary embodiment.

Referring to FIG. 21, the DDI 200*c* may include a receive (RX) interface 210, a memory controller 220, a graphic memory 230, and a decoder 270. The DDI 200*c* may further include a shift register controller, a shift register, and a source driver.

The DDI 200*c* of FIG. 21 is a modified example of the DDI 200*a* of FIG. 6, and the DDI 200*c* of FIG. 21 may further include the decoder 270.

The receive interface 210 may receive from the outside, for example, from a host processor 100, 100*a*, or 100*b*, compressed image data and a control signal. When multiple partial update is performed according to an exemplary embodiment, the receive interface 210 may receive compressed update image data UIMG_ECD from a host processor 100, 100*a*, or 100*b*. The receive interface 210 may provide the memory controller 220 with compressed update image data UIMG_ECD and split information INFO_split.

The compressed update image data UIMG_ECD may be split into a plurality of compressed image data according to control of the image splitting unit 201*a* included in the memory controller 220, and the split, plurality of compressed image data may be stored in separate storage regions of the graphic memory 230. As the compressed image data is stored in the graphic memory 230, a capacity of the graphic memory 230 may be smaller than a capacity of frame image data displayed on the display panel 300. Accordingly, a layout area of the graphic memory 230 may be reduced.

The decoder 270 may restore compressed data that is in row units and is output from the graphic memory 230 by decoding. The restored row-unit data, that is, line data, may be provided to a source driver. The line data may be temporarily stored in a shift register according to control of a shift register controller and then provided to the source driver at a later time.

Figure 22:
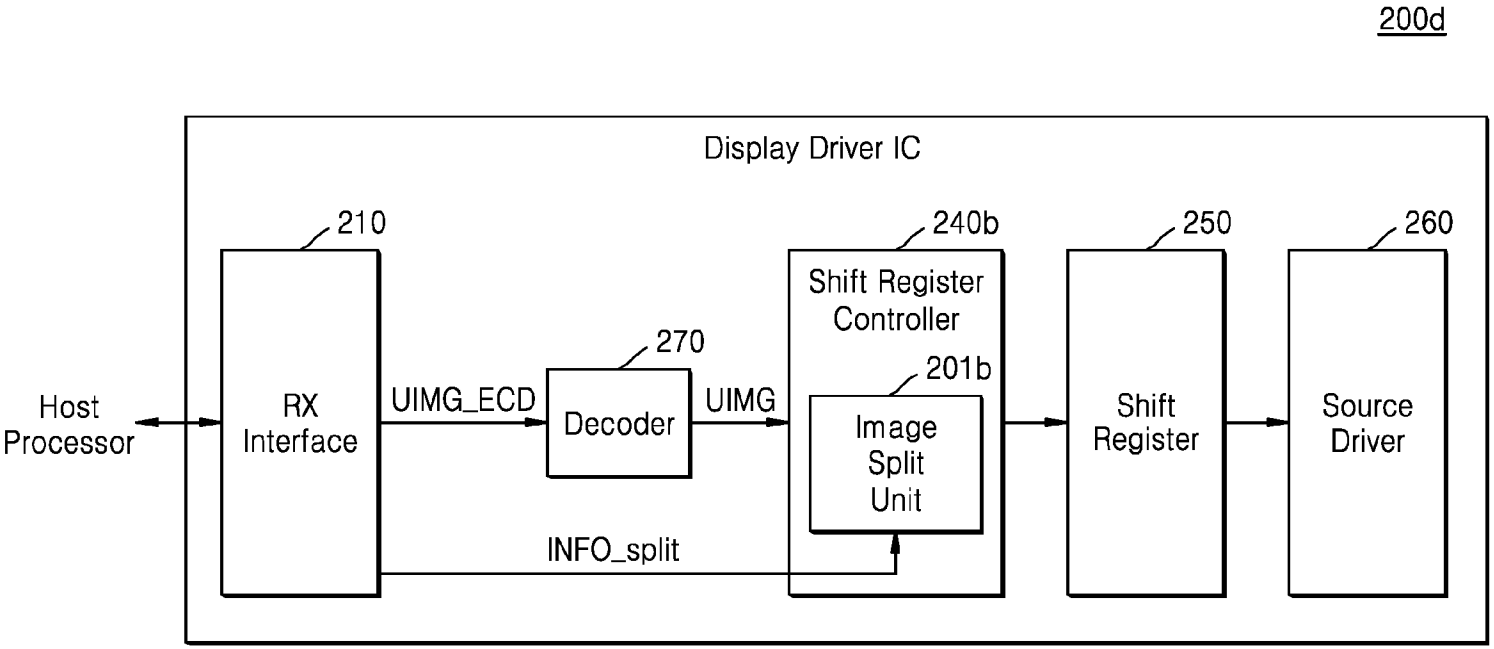
FIG. 22 is a block diagram illustrating a DDI according to another exemplary embodiment.

FIG. 22 is a block diagram illustrating a DDI 200*d* according to another exemplary embodiment.

The DDI 200*d* of FIG. 22 is a modified example of the DDI 200*b* of FIG. 16. Referring to FIG. 22, the DDI 200*d* may include a receive (RX) interface 210, a decoder 270, a shift register controller 240*b*, a shift register 250, and a source driver 260.

The receive interface 210 may receive compressed image data from the outside, for example, from a host processor 100, 100*a*, or 100*b*. When multiple partial update is performed according to an exemplary embodiment, the receive interface 210 may receive compressed update image data UIMG_ECD from a host processor 100, 100*a*, or 100*b*.

The decoder 270 may restore the compressed update image data UIMG_ECD and provide the same to the shift register controller 240*b*.

The image splitting unit 201*b* included in the shift register controller 240*b* may split received update image data UIMG into a plurality of image data, and may provide the shift register 250 with the plurality of image data. Operations of the shift register controller 240*b* and the shift register 250 are described above with reference to FIGS. 16 through 19, and thus a redundant description thereof will be omitted below.

Figure 23:
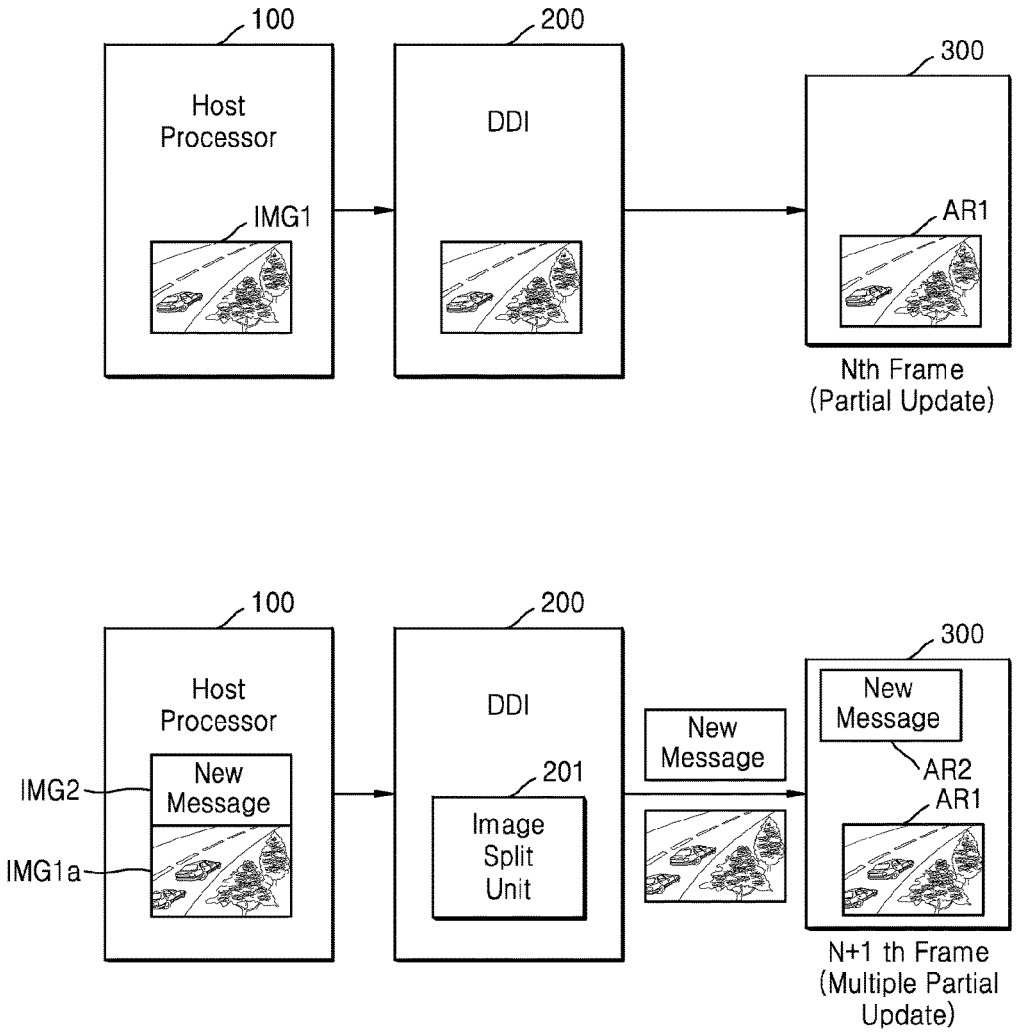
FIG. 23 is a view for explaining an example of multiple partial update according to an exemplary embodiment.

FIG. 23 is a view for explaining an example of multiple partial update method according to an exemplary embodiment.

Referring to FIG. 23, a first partial region AR1 of the display panel 300 may display a video. Accordingly, an image may be updated at a predetermined frame rate, for example, at 60 frames per second (fps) in the first partial region AR1. Partial update on the first partial region AR1 may be performed up to an Nth frame.

Meanwhile, in an (N+1)th frame, multiple partial update may be performed, according to which an update with respect to a second partial region AR2 is performed in addition to an update with respect to the first partial region AR1. At the same time when the first partial region AR1 is updated at 60 fps, the second partial region AR2 may be updated to a new image. To this end, the host processor 100, 100*a*, or 100*b* may generate update image data by merging first image data IMG1*a* to be displayed on the first partial region AR1 and second image data IMG2 to be displayed on the second partial region AR2.

The image splitting unit 201 (e.g., image splitter) of the DDI 200, 200*a*, 200*b*, 200*c*, or 200*d* may split update image data received from the host processor 100, 100*a*, or 100*b* into the first image data IMG1*a* and the second image data IMG2. In the (N+1)th frame display period, the DDI 200, 200*a*, 200*b*, 200*c*, or 200*d* may update the first partial region AR1 and the second partial region AR2 of the display panel 300 based on the first image data IMG1*a* and the second image data IMG2. Accordingly, the first partial region AR1 and the second partial region AR2 of the display panel 300 may be updated substantially simultaneously.

Figure 24:
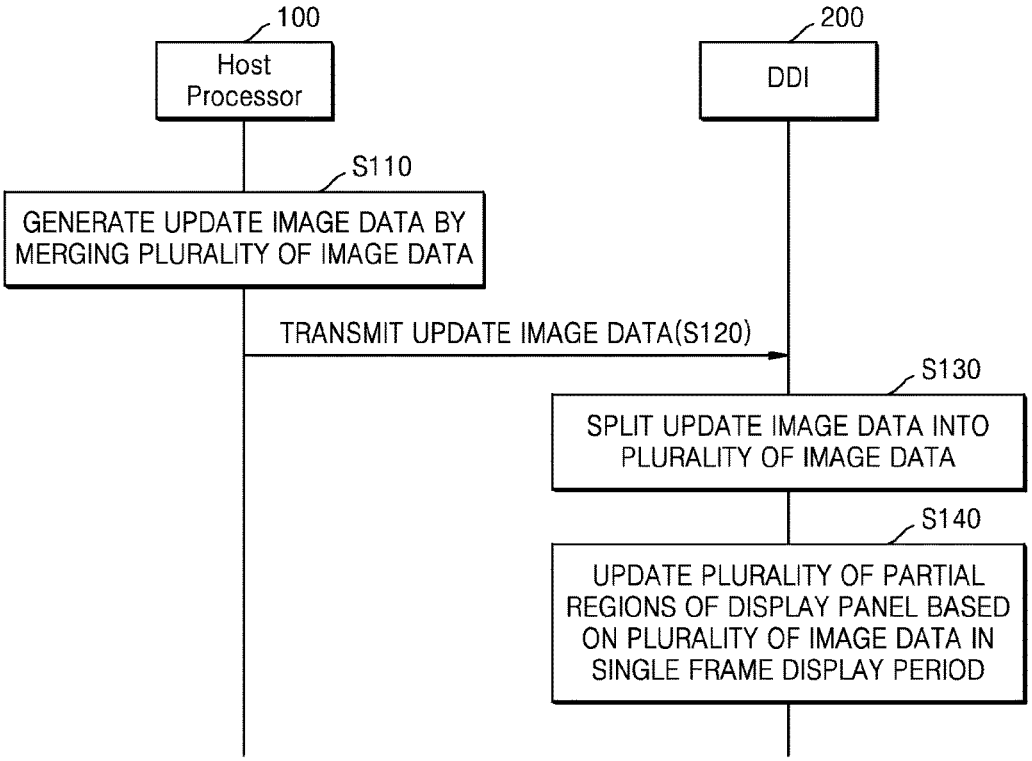
FIG. 24 is a flowchart of a method of operating a display system according to an exemplary embodiment.

FIG. 24 is a flowchart of a method of operating a display system according to an exemplary embodiment.

The method of operating a display system of FIG. 24 is directed to a multiple partial update method, and the multiple partial update method described above with reference to FIGS. 1 through 4, 5A and 5B, 6 through 8, 9A and 9B, 10, 11A and 11B, 12A and 12B, 13A and 13B, 14A and 14B, 15A and 15B, and 16 through 23 may be applied to the method of FIG. 24.

Referring to FIG. 24, the host processor 100, 100*a*, or 100*b* generates update image data by merging a plurality of image data in operation S110. The plurality of image data may correspond to images to be respectively displayed in a plurality of partial regions that are separate from one another on a display panel 300.

The host processor 100, 100*a*, or 100*b* may transmit the update image data to the DDI 200, 200*a*, 200*b*, 200*c*, or 200*d* in operation S120. According to an exemplary embodiment, the host processor 100, 100*a*, or 100*b* may transmit update image data in response to a transmission trigger signal received from the DDI 200, 200*a*, 200*b*, 200*c*, or 200*d*, for example, a TE signal. According to another exemplary embodiment, the host processor 100 may transmit update image data after transmitting a vertical synchronization signal.

The DDI 200, 200*a*, 200*b*, 200*c*, or 200*d* may split the update image data into a plurality of image data in operation S130. The DDI 200, 200*a*, 200*b*, 200*c*, or 200*d* may split the update image data based on a control signal received from the host processor 100, 100*a*, or 100*b*. The control signal may include split information about the update image data. The DDI 200, 200*a*, 200*b*, 200*c*, or 200*d* may update a plurality of partial regions of the display panel 300 during one frame display period based on the plurality of image data in operation S140.

Figure 25:
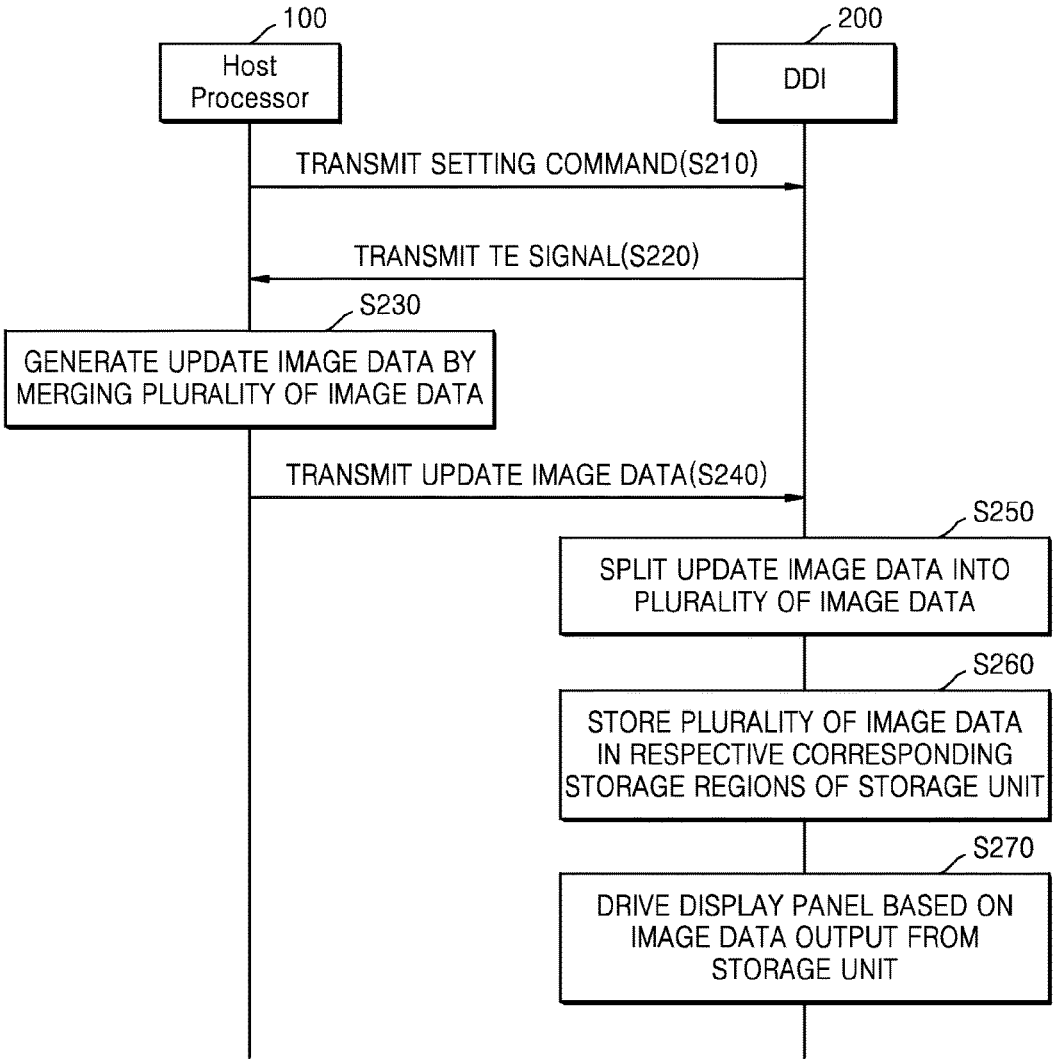
FIG. 25 is a detailed flowchart of a method of operating a display system according to an exemplary embodiment.

FIG. 25 is a detailed flowchart of a method of operating a display system according to an exemplary embodiment.

Referring to FIG. 25, the host processor 100, 100*a*, or 100*b* may transmit a setting command in operation S210. The setting command may include a multiple partial update command and setting information about partial regions that are to be updated.

In operation S220, the DDI 200, 200*a*, 200*b*, 200*c*, or 200*d* may transmit a TE signal to the host processor 100, 100*a*, or 100*b* in order to indicate that the DDI 200 is in a state able to receive image data. According to another exemplary embodiment, operation S220 may be omitted.

The host processor 100, 100*a*, or 100*b* may generate update image data by merging a plurality of image data to be updated in operation S230, and may transmit the update image data to the DDI 200, 200*a*, 200*b*, 200*c*, or 200*d* in response to a TE signal.

The DDI 200, 200*a*, 200*b*, 200*c*, or 200*d* may split the update image data into a plurality of image data in operation S250, and store the plurality of image data in respective storage regions of a storage unit (e.g., storage) in operation S260. Accordingly, some regions of the storage unit may be updated. According to an exemplary embodiment, the storage unit may be a graphic memory (e.g., frame memory) 230 that stores frame image data. According to another exemplary embodiment, the storage unit may be a shift register 250 storing line data.

The DDI 200, 200*a*, 200*b*, 200*c*, or 200*d* may drive a display panel 300 based on image data output from the storage unit in operation S270. As data of some storage regions of the storage unit is updated to the plurality of image data, the plurality of partial regions of the display panel may be updated.

Figure 26:
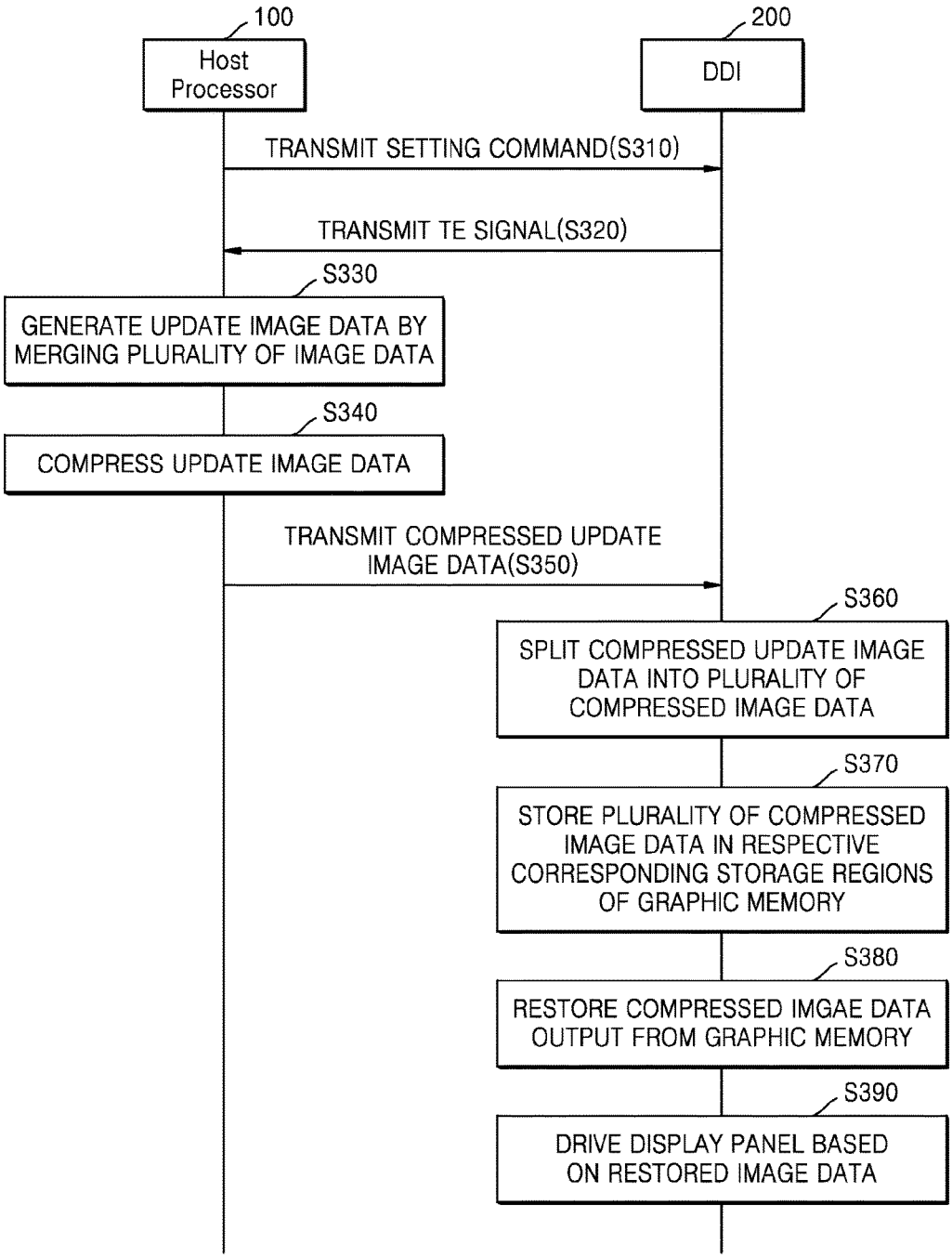
FIG. 26 is a detailed flowchart of a method of operating a display system according to another exemplary embodiment.

FIG. 26 is a detailed flowchart of a method of operating a display system according to another exemplary embodiment.

Referring to FIG. 26, when the host processor 100, 100*a*, or 100*b* transmits a setting command to the DDI 200 in operation S310, the DDI 200, 200*a*, 200*b*, 200*c*, or 200*d* may transmit a TE signal to the host processor 100, 100*a*, or 100*b* in operation S320 in order to indicate that the DDI 200, 200*a*, 200*b*, 200*c*, or 200*d* is in a state able to receive image data.

The host processor 100, 100*a*, or 100*b* may generate update image data by merging a plurality of image data to be updated, in operation S330, and compress the update image data by encoding the same in operation S340.

The host processor 100 may transmit the compressed update image data to the DDI 200, 200*a*, 200*b*, 200*c*, or 200*d* in operation S340. As a data transmission amount of the host processor 100, 100*a*, or 100*b* is reduced, power consumption of a display system may be reduced.

The DDI 200, 200*a*, 200*b*, 200*c*, or 200*d* may split the compressed update image data into a plurality of compressed image data in operation S360, and may store the plurality of compressed image data in corresponding storage regions of a storage unit (e.g., storage) in operation S370. According to an exemplary embodiment, the storage unit may be a graphic memory 230.

The DDI 200, 200*a*, 200*b*, 200*c*, or 200*d* may drive a display panel 300 based on image data output from the storage unit. The storage unit stores compressed image data, and thus data output from the storage unit is compressed data. Accordingly, the DDI 200, 200*a*, 200*b*, 200*c*, or 200*d* may decode the compressed data output from the storage unit to restore the image data in operation S380, and may drive the display panel 300 based on the restored image data.

According to the multiple partial update method of the present exemplary embodiment, by transmitting compressed data and storing the same in the storage unit, power consumption of the display system due to data transmission and reception may be reduced, and a layout area of the storage unit (e.g., graphic memory) included in the DDI 200, 200*a*, 200*b*, 200*c*, or 200*d* may be reduced.

Figure 27:
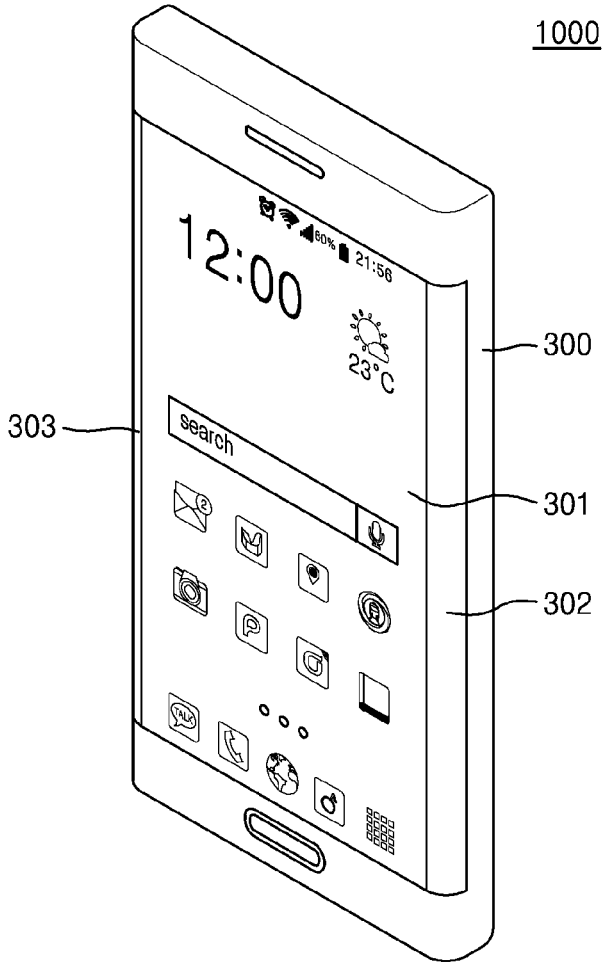
FIG. 27 illustrates an electronic device in which a display system according to an exemplary embodiment is mounted, according to an exemplary embodiment.

FIG. 27 illustrates an electronic device 1000 in which a display system according to an exemplary embodiment is mounted, according to an exemplary embodiment.

Referring to FIG. 27, the electronic device 1000 is a mobile device and may include the display panel 300 on a front surface portion thereof. The host processor 100 (FIG. 1) and the DDI 200 (FIG. 1) may be included inside the electronic device 1000, and the host processor 100 may be an application processor mounted in a mobile electronic device.

The display panel 300 may be a flexible display including a main display area 301 as well as a first auxiliary display area 302 and a second auxiliary display area 303 that extend from the main display area 301 and are bent from two corners of the main display area 301.

According to an exemplary embodiment, multiple partial update may be performed as the first auxiliary display area 302 and the second auxiliary display area 303 of the display panel 300 are simultaneously updated (e.g., during one frame display period) without updating the main display area 301. According to another exemplary embodiment, multiple partial update may be performed as at least one of the first auxiliary display area 302 and the second auxiliary display area 303 and a portion of the main display area 301 are simultaneously updated. For example, the first auxiliary display area 302 and a portion of the main display area 301 may be simultaneously updated. The multiple partial update method described above with reference to FIGS. 1 through 4, 5A and 5B, 6 through 8, 9A and 9B, 10, 11A and 11B, 12A and 12B, 13A and 13B, 14A and 14B, 15A and 15B, and 16 through 26 may be applied to the electronic device 1000.

Figure 28:
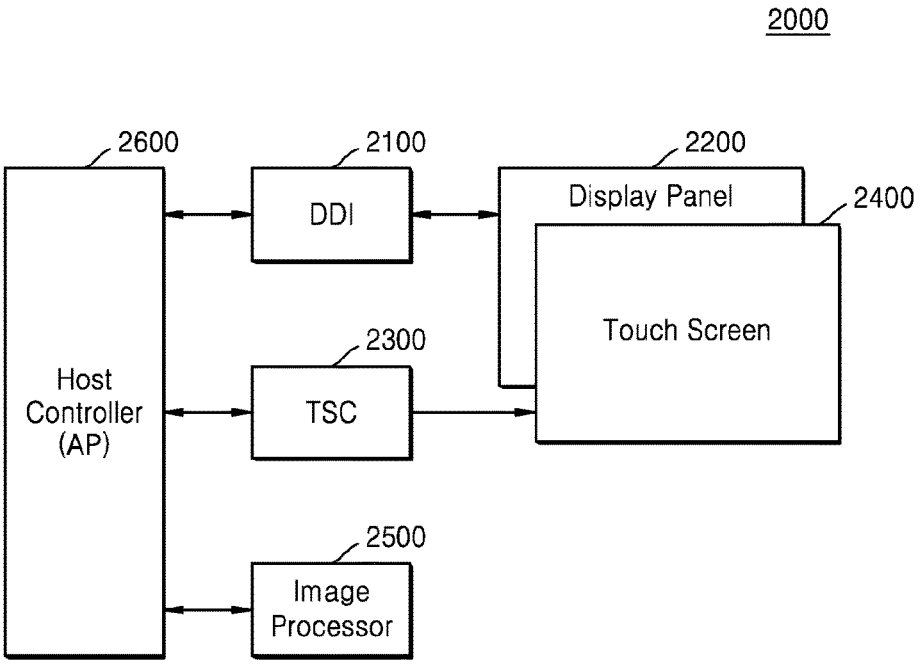
FIG. 28 is a block diagram illustrating a touch screen system, to which a display system according to an exemplary embodiment is applied.

FIG. 28 is a block diagram illustrating a touch screen system 2000 to which a display system according to an exemplary embodiment is applied.

Referring to FIG. 28, the touch screen system 2000 includes a host 2600, a DDI 2100, a display panel 2200, a touch screen controller 2300, a touch screen 2400, and an image processor 2500.

The host 2600 may receive data and/or a command from a user, and may control the DDI 2100 and the touch screen controller 2300 based on the received data and/or command. The host 2600 may be an application processor or a graphic card.

The image processor 2500 may process image data. The image processor 2500 may generate image data to be provided to the DDI 2100, and may perform image processing on image data based on a touch signal provided from the touch screen controller 2300. According to an exemplary embodiment, the image processor 2500 may be included in the host 2600.

The DDI 2100 may drive the display panel 2200 according to control of the host 2600. The DDI 2100 may receive image data from the host 2600 or the image processor 2500 and may drive the display panel 2200 based on the image data.

The touch screen controller 2500 may be connected to the touch screen 2400 to receive sensing data from the touch screen 2400 and transmit the sensing data to the host 2600.

The touch screen 2400 may overlap with the display panel 2200. According to an exemplary embodiment, the touch screen 2400 may be integrally formed with the display panel 2200.

According to an exemplary embodiment, the DDI 200 and the touch screen controller 2500 may share multiple functional blocks, and the DDI 200 and the touch screen controller 2500 may be formed as a single semiconductor chip.

According to the multiple partial update methods described with reference to FIGS. 1 through 4, 5A and 5B, 6 through 8, 9A and 9B, 10, 11A and 11B, 12A and 12B, 13A and 13B, 14A and 14B, 15A and 15B, and 16 through 26 above, the host 2600 may provide the DDI 2100 with update image data obtained by merging a plurality of image data to be displayed in a plurality of partial regions of the display panel 2200. The DDI 2100 may split update image data into the plurality of image data, and may update the plurality of partial regions of the display panel 2600 based on the plurality of image data in a frame display period.

Figure 29:
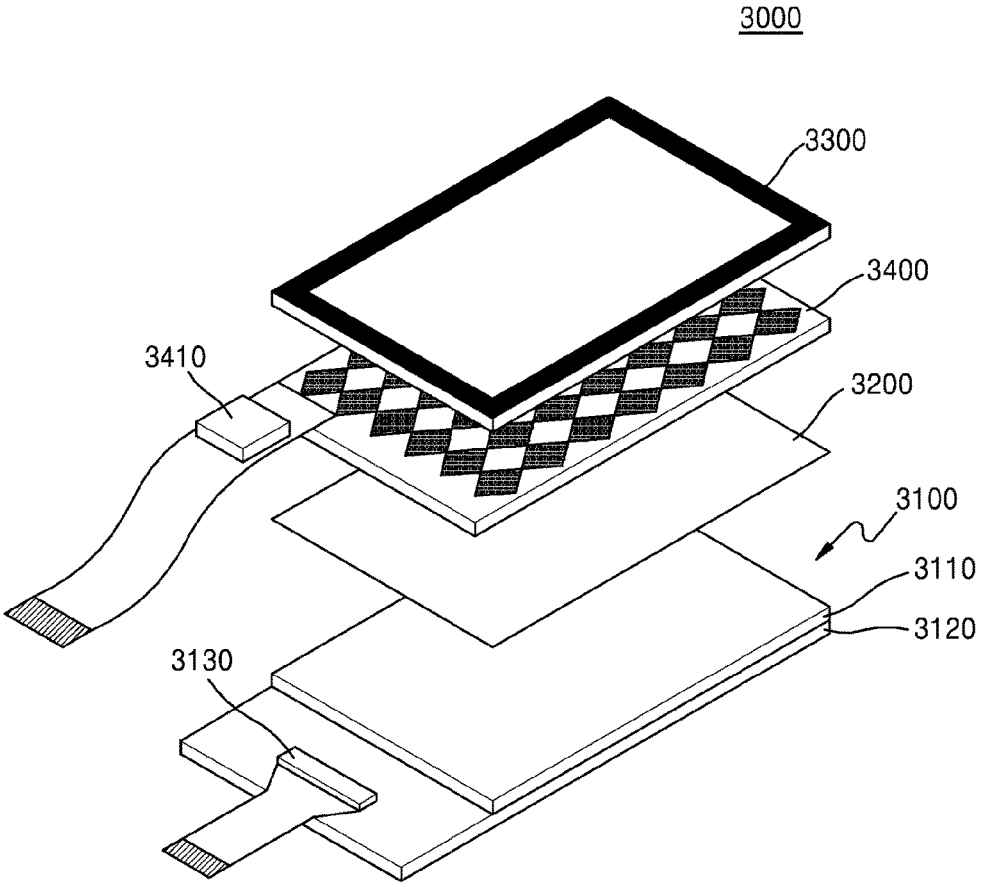
FIG. 29 illustrates a touch screen module according to an exemplary embodiment.

FIG. 29 illustrates a touch screen module 3000 according to an exemplary embodiment.

Referring to FIG. 29, the touch screen module 3000 may include a display device 3100, a polarization plate 3200, a touch panel 3400, a touch controller 3410, and a window glass 3300. The display device 3100 may include a display panel 3100, a printed circuit board 3120, and a display driving circuit 3130. The display driving circuit 3130 may include the DDI 200, 200*a*, 200*b*, 200*c*, or 200*d* according to exemplary embodiments described above with reference to FIGS. 1 through 4, 5A and 5B, 6 through 8, 9A and 9B, 10, 11A and 11B, 12A and 12B, 13A and 13B, 14A and 14B, 15A and 15B, and 16 through 26.

The window glass 3300 may be formed of (e.g., include) a material such as acryl or reinforced glass to protect the touch screen module 2000 from external impact or scratches due to repetitive touches. The polarization plate 3200 may be included in order to improve optical characteristics of the display panel 3100. The display panel 3110 may be formed of a transparent electrode patterned on the printed circuit board 3120. The display panel 3100 may include a plurality of pixels to display a frame. According to an exemplary embodiment, the display panel 3110 may be a liquid crystal panel. However, it is understood that the display panel 3110 is not limited thereto in one or more other exemplary embodiments, and may include various types of display devices. For example, the display panel 3110 may be one of an organic light emitting diode (OLED) panel, an active-matrix OLED (AMOLED) panel, an electrochromic display (ECD), a digital mirror device (DMD), an actuated mirror device (AMD), a grating light value (GLV), a plasma display panel (PDP), an electro luminescent display (ELD), a light emitting diode (LED) display, and a vacuum fluorescent display (VFD).

While the display driving circuit 3130 is illustrated as a chip in the present exemplary embodiment, this is merely for convenience of illustration, and the display driving circuit 3130 may also be included as multiple chips. Also, the display driving circuit 3130 may be mounted on a printed circuit board as a chip on glass (COG). However, it is understood that this is merely exemplary, and the display driving circuit 3130 may be mounted in various forms such as a chip on film (COF), a chip on board (COB), or the like.

The touch panel 3400 may be formed of (e.g., include) a transparent electrode such as indium tin oxide (ITO), that is patterned on a glass substrate or a polyurethane terephtahalate (PET) film. According to an exemplary embodiment, the touch panel 3400 may be formed on the display panel 3110. For example, pixels of the touch panel 3400 may be merged with pixels of the display panel 3110. The touch controller 3410 may sense a touch event on the touch panel 3400 and calculate touch coordinates and transmit the touch coordinates to a host. The touch controller 3410 may be integrated to a single semiconductor circuit with the display driving circuit 3130.

Figure 30:
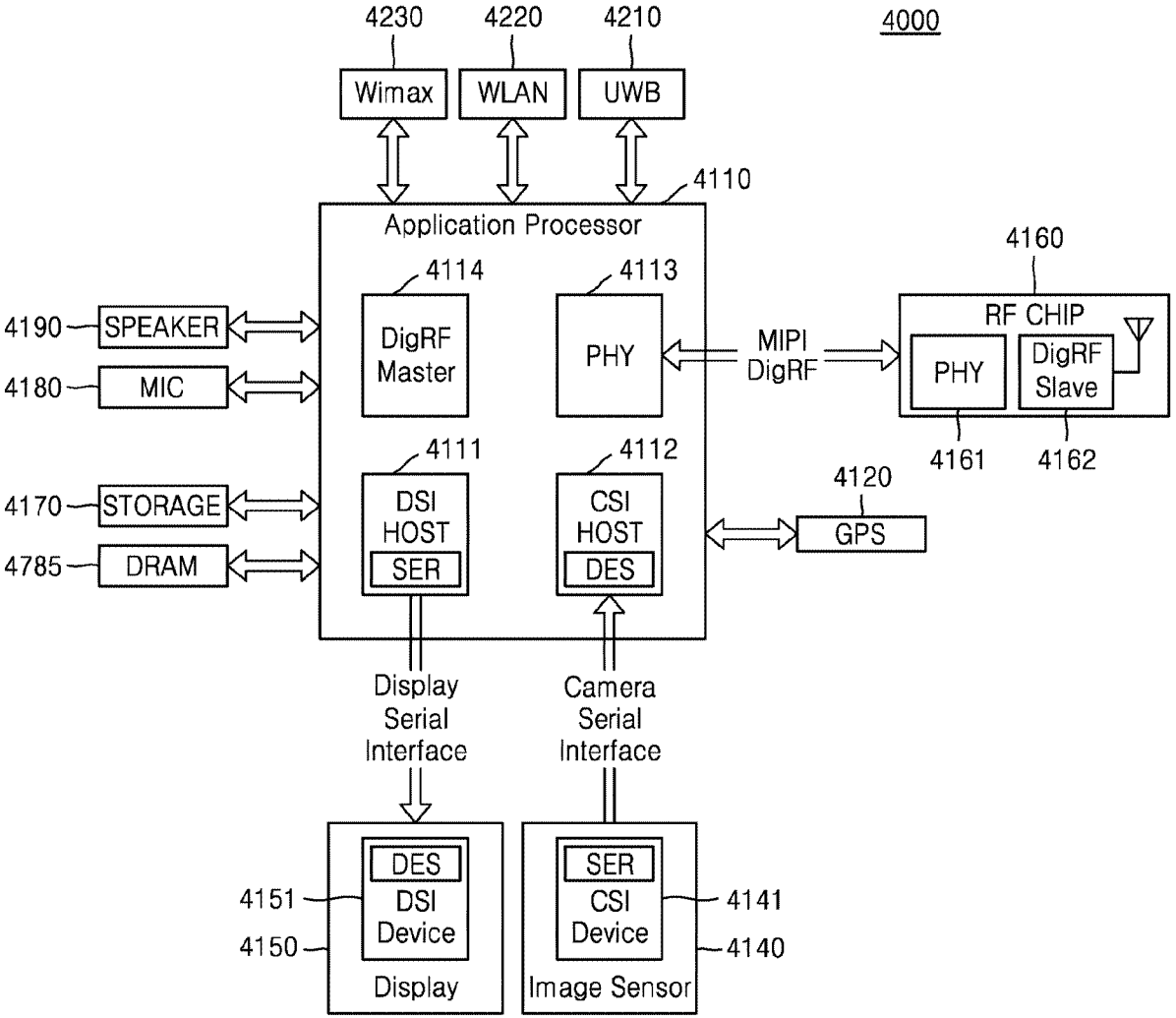
FIG. 30 is a block diagram illustrating an electronic system including a display device according to an exemplary embodiment.

FIG. 30 is a block diagram illustrating an electronic system 4000 including a display device according to an exemplary embodiment.

Referring to FIG. 30, the electronic system 4000 may be formed of (e.g., include) a data processing device that is capable of using or supporting a MIPI interface, such as a mobile phone, a PDA, a PMP, or a smartphone.

The electronic system 4000 includes an application processor 4110, an image sensor 4140, and a display device 4150. The display device 4150 may be include a DDI 200, 200*a*, 200*b*, 200*c*, 200*d* according to exemplary embodiments described above.

A camera serial interface (CSI) host 4112 implemented in the application processor 4110 may communicate with a CSI device 4141 of the image sensor 4140 via a CSI. For example, an optical deserializer may be included in the CSI host 4112, and an optical serializer may be included in the CSI device 4141.

The DSI host 4111 included in the application processor 4110 may perform serial communication with a display serial interface (DSI) device 4151 of the display 4150 via a DSI. For example, an optical serializer may be included in the DSI host 4111, and an optical deserializer may be included in the DSI device 4151.

The electronic system 4000 may further include a radio frequency (RF) chip 4160 that is capable of communicating with the application processor 4110. A physical layer (PHY) 4113 of the application processor 4110 and a physical layer (PHY) 4161 of the RF chip 4160 may transmit or receive data to or from each other according to MIPI DigRF standards.

The electronic device 4000 may further include a global positioning system (GPS) module, element, or chip 4120, a storage 4170, a microphone 4180, a DRAM 4785, and a speaker 4190. The electronic system 4000 may perform communication via Wimax 4230, a WLAN 4220, Ultra-wideband (UWB) 4210, or the like.

While not restricted thereto, an exemplary embodiment can be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Also, an exemplary embodiment may be written as a computer program transmitted over a computer-readable transmission medium, such as a carrier wave, and received and implemented in general-use or special-purpose digital computers that execute the programs. Moreover, it is understood that in exemplary embodiments, one or more of the above-described elements can include circuitry, a processor, a microprocessor, etc., and may execute a computer program stored in a computer-readable medium.

While exemplary embodiments have been particularly shown and described above, it will be understood that various changes in form and details may be made therein without departing from the spirit and scope of the following claims.

What is claimed is:

1. A display driver integrated circuit for driving a display panel, the display driver integrated circuit comprising:

an interface configured to receive, from a host processor distinct from the display driver integrated circuit, a control signal and image data, a sum of a number of columns and a number of rows of the image data being less than a sum of a number of columns and a number of rows of the display panel;

an image splitter configured to split, based on the control signal, the image data into a plurality of image data respectively corresponding to a plurality of partial regions of the display panel, the plurality of partial regions being separate from each other;

a storage configured to store the plurality of image data in a plurality of storage areas respectively corresponding to the plurality of partial regions; and a source driver configured to drive the display panel based on the plurality of image data output from the storage during one frame period, wherein the image splitter is configured to, based on the control signal, control to update the plurality of storage areas respectively corresponding to the plurality of partial regions with the plurality of image data, and to control to maintain previous image data of a previous frame period in a storage area of the storage that does not correspond to any of the plurality of partial regions.

2. The display driver integrated circuit according to claim 1, wherein the control signal comprises a multiple partial update parameter indicating that a current operation is to update multiple partial regions of the display panel.

3. The display driver integrated circuit according to claim 2, wherein the control signal further comprises address information of the plurality of storage areas.

4. The display driver integrated circuit according to claim 3, wherein the address information comprises at least one of:

a first indicator indicating a start column and an end column; and a second indicator indicating a start row and an end row.

5. The display driver integrated circuit according to claim 4, wherein:

the first indicator indicates a start column and an end column of a minimum rectangular region including the plurality of storage areas; and the second indicator indicates a start row and an end row of the minimum rectangular region.

6. The display driver integrated circuit according to claim 4, wherein the control signal further comprises size information of the plurality of storage areas.

7. The display driver integrated circuit according to claim 6, wherein the size information comprises at least one of a plurality of horizontal sizes and a plurality of vertical sizes respectively of the plurality of storage areas.

8. The display driver integrated circuit according to claim 1, wherein the interface is configured to receive the control signal, to transmit a tearing effect signal in response to the received control signal, and to receive the image data in response to the transmitted tearing effect signal.

9. The display driver integrated circuit according to claim 1, wherein the interface is configured to communicate with the host processor based on a MOBILE INDUSTRY PROCESSOR INTERFACE (MIPI) method.

10. The display driver integrated circuit according to claim 1, wherein the image splitter is implemented as hardware.

11. The display driver integrated circuit according to claim 1, wherein the image splitter is configured to control to store the plurality of image data into the plurality of storage areas of the storage by moving a write pointer of the storage based on an offset obtained from the control signal.

12. The display driver integrated circuit according to claim 11, wherein the image splitter is configured to, when the write pointer corresponds to a write address of an end column of a first storage area, among the plurality of storage areas, obtain as the offset an address difference from the end column of the first storage area to a start column of a second storage area, among the plurality of storage areas.

13. A method of driving a display panel, the method comprising:

receiving, by a display driver integrated circuit, a control signal and image data from a host processor distinct from the display driver, a sum of a number of columns and a number of rows of the image data is less than a sum of a number of columns and a number of rows of the display panel;

splitting, based on the control signal, the image data into a plurality of image data respectively corresponding to a plurality of partial regions of the display panel, the plurality of partial regions being separate from each other;

storing, in a storage, the plurality of image data in a plurality of storage areas respectively corresponding to the plurality of partial regions; and driving the display panel based on the plurality of image data output from the storage during one frame period, wherein the storing comprises, based on the control signal, controlling to update the plurality of storage areas respectively corresponding to the plurality of partial regions with the plurality of image data, and controlling to maintain previous image data of a previous frame period in a storage area of the storage that does not correspond to any of the plurality of partial regions.

14. The method according to claim 13, wherein the control signal comprises a multiple partial update parameter indicating that a current operation is to update multiple partial regions of the display panel.

15. The method according to claim 14, wherein the control signal further comprises address information of the plurality of storage areas.

16. The method according to claim 15, wherein the control signal further comprises size information of the plurality of storage areas.

17. The method according to claim 13, wherein the receiving the control signal and the image data comprises sequentially receiving the image data in row units from a start row to an end row of the plurality of partial regions.

18. The method according to claim 13, wherein the receiving the control signal and the image data comprises receiving the control signal, transmitting a tearing effect signal in response to the received control signal, and receiving the image data in response to the transmitted tearing effect signal.

19. The method according to claim 13, wherein the storing comprises storing the plurality of image data into the plurality of storage areas of the storage by moving a write pointer of the storage based on an offset obtained from the control signal.

20. The method according to claim 19, wherein the storing further comprises, when the write pointer corresponds to a write address of an end column of a first storage area, among the plurality of storage areas, obtaining as the offset an address difference from the end column of the first storage area to a start column of a second storage area, among the plurality of storage areas.

* * * * *